US009913510B2

(12) United States Patent
Davis et al.

(10) Patent No.: US 9,913,510 B2
(45) Date of Patent: Mar. 13, 2018

(54) ARTICLES OF FOOTWEAR

(75) Inventors: Paul Davis, Blackstone, MA (US); Paul E. Litchfield, Westboro, MA (US); William Marvin, Canton, MA (US)

(73) Assignee: REEBOK INTERNATIONAL LIMITED, London (GB)

( * ) Notice: Subject to any disclaimer, the term of this patent is extended or adjusted under 35 U.S.C. 154(b) by 878 days.

(21) Appl. No.: 13/428,897

(22) Filed: Mar. 23, 2012

(65) Prior Publication Data

US 2013/0247425 A1 Sep. 26, 2013

(51) Int. Cl.

| | |
|---|---|
| ***A43B 13/14*** | (2006.01) |
| ***A43B 3/00*** | (2006.01) |
| ***A43B 13/12*** | (2006.01) |
| ***A43B 13/02*** | (2006.01) |

(52) U.S. Cl.

CPC ..... *A43B 13/141* (2013.01); *A43B 3/0057* (2013.01); *A43B 13/02* (2013.01); *A43B 13/026* (2013.01); *A43B 13/125* (2013.01); *A43B 13/14* (2013.01)

(58) Field of Classification Search

CPC ... A43B 3/0057; A43B 13/023; A43B 13/026; A43B 13/12; A43B 13/125; A43B 13/14; A43B 13/42

USPC ..... 36/25 R, 30 R, 30 A, 31, 107

See application file for complete search history.

(56) References Cited

U.S. PATENT DOCUMENTS

| | | | |
|---|---|---|---|
| 485,459 | A | 11/1892 | Crocker |
| 1,594,056 | A | 7/1926 | Floyd |
| 1,607,375 | A | 11/1926 | Whipple |
| D108,320 | S | 2/1938 | Eldon |
| D133,176 | S | 7/1942 | Gregg |
| D136,381 | S | 9/1943 | Ghez et al. |
| D149,139 | S | 3/1948 | Parker |
| D157,034 | S | 1/1950 | Eldon |
| D173,030 | S | 9/1954 | Hoza |
| 2,710,461 | A | 6/1955 | Hack |
| 2,722,756 | A | 11/1955 | Ecclesine |
| 3,444,632 | A | 5/1969 | Hack et al. |
| D233,805 | S | 12/1974 | Kubo |

(Continued)

FOREIGN PATENT DOCUMENTS

| | | | |
|---|---|---|---|
| CN | 1161817 | A | 10/1997 |
| CN | 101980625 | A | 2/2011 |

(Continued)

OTHER PUBLICATIONS

Adidas Q2 2007 Footwear Catalog, p. 5, showing the T 7 ATS shoe, and p. 122, showing the J S3 W shoe, 2 pages.

(Continued)

*Primary Examiner* — Sharon M Prange

(74) *Attorney, Agent, or Firm* — Sterne, Kessler, Goldstein & Fox P.L.L.C.

(57) ABSTRACT

A sole for an article of footwear includes a fiber-reinforced polymer plate extending from a heel area of the article of footwear to a toe area of the article of footwear, wherein flexibility of the fiber-reinforced polymer plate varies as a function of location along a longitudinal axis of the fiber-reinforced polymer plate, and wherein the fiber-reinforced polymer plate includes a stiffening layer disposed at a midfoot area of the fiber-reinforced polymer plate.

22 Claims, 18 Drawing Sheets

(56) References Cited

U.S. PATENT DOCUMENTS 4,071,963 A 2/1978 Fukuoka
4,130,947 A 12/1978 Oenu
4,170,078 A 10/1979 Moss
D274,574 S 7/1984 Stubblefield
4,561,195 A 12/1985 Onoda et al.
4,642,917 A 2/1987 Ungar
4,651,445 A * 3/1987 Hannibal ..... 36/103
4,688,338 A * 8/1987 Brown ..... A43B 17/14 12/146 M
D296,149 S 6/1988 Diaz
4,798,010 A 1/1989 Sugiyama
4,805,319 A 2/1989 Tonkel
4,864,737 A 9/1989 Marrello
D316,324 S 4/1991 Rogers
5,044,096 A 9/1991 Polegato
5,052,130 A * 10/1991 Barry et al. ..... 36/107
D324,131 S 2/1992 Lucas
D325,288 S 4/1992 Richard et al.
D326,014 S 5/1992 Issler
D327,362 S 6/1992 Hartfield
5,185,943 A 2/1993 Tong et al.
D334,282 S 3/1993 Greene
D336,771 S 6/1993 Harfield et al.
D347,516 S 6/1994 Foster
5,319,866 A 6/1994 Foley et al.
D356,206 S 3/1995 Martin
5,401,564 A 3/1995 Lee et al.
D357,346 S 4/1995 Ho
5,406,723 A 4/1995 Okajima
D360,065 S 7/1995 Werman
D364,497 S 11/1995 Schelling
5,469,639 A 11/1995 Sessa
D367,952 S 3/1996 Shea
5,528,842 A 6/1996 Ricci et al.
D378,011 S 2/1997 Lucas
D379,259 S 5/1997 Kayano
D385,987 S 11/1997 Braman
D390,346 S 2/1998 Loveder
5,713,140 A 2/1998 Baggenstoss
D394,945 S 6/1998 Doxey
D395,739 S 7/1998 Mervar
D396,947 S 8/1998 Serna
D397,847 S 9/1998 Hudson
5,799,415 A 9/1998 Kenji et al.
5,822,886 A 10/1998 Luthi et al.
5,832,634 A * 11/1998 Wong ..... 36/107
D402,455 S 12/1998 Greenberg
D412,236 S 7/1999 von Contal
5,918,338 A * 7/1999 Wong ..... 12/146 S
D414,316 S 9/1999 Lozano
D415,610 S 10/1999 Cahill
5,987,782 A 11/1999 Bramani
6,009,637 A 1/2000 Pavone
D420,497 S 2/2000 Panella
D421,834 S 3/2000 Cooper
D424,287 S 5/2000 Edwards
6,079,125 A 6/2000 Quellais et al.
6,108,943 A 8/2000 Hudson et al.
6,138,385 A 10/2000 Jungkind et al.
6,205,681 B1 3/2001 Kita
6,219,939 B1 4/2001 Kita et al.
6,219,940 B1 4/2001 Kita
D442,357 S 5/2001 Burt
6,226,896 B1 5/2001 Friton
6,289,608 B1 9/2001 Kita et al.
D449,433 S 10/2001 Matis et al.
6,295,741 B1 10/2001 Kita
6,311,414 B1 11/2001 Kita
6,314,664 B1 11/2001 Kita et al.
6,338,206 B1 1/2002 Kita
6,389,713 B1 5/2002 Kita
6,393,732 B1 5/2002 Kita
6,401,365 B2 6/2002 Kita et al.
6,418,641 B1 7/2002 Schenkel
6,438,873 B1 8/2002 Gebhard et al.
D465,079 S 11/2002 Merceron
6,516,539 B2 2/2003 Nishiwaki et al.
6,557,270 B2 5/2003 Nakano et al.
6,557,274 B2 5/2003 Litchfield et al.
D475,509 S 6/2003 Avar
6,606,804 B2 8/2003 Kaneko et al.
6,625,905 B2 9/2003 Kita
6,647,645 B2 11/2003 Kita
6,675,500 B1 1/2004 Cadamuro
6,694,642 B2 2/2004 Turner
6,711,834 B1 3/2004 Kita
D489,525 S 5/2004 Snow et al.
D489,881 S 5/2004 Recchi
D490,599 S 6/2004 Snow et al.
6,754,981 B1 6/2004 Edwards
D495,128 S 8/2004 Avar
D497,046 S 10/2004 Scott
6,810,605 B2 11/2004 Nakano et al.
D499,247 S 12/2004 Wahoske et al.
6,964,119 B2 11/2005 Weaver, III
D515,305 S 2/2006 Andrews-Kramer
D515,306 S 2/2006 Andrews-Kramer
D516,293 S 3/2006 Smith, III
D523,232 S 6/2006 Shaffer
D523,614 S 6/2006 Mitchell
D523,627 S 6/2006 Avar
D523,628 S 6/2006 Young
7,055,198 B2 6/2006 Cadamuro et al.
D524,034 S 7/2006 Hlavacs
D524,035 S 7/2006 Greene et al.
D524,535 S 7/2006 Cass
7,089,152 B2 8/2006 Oda et al.
D528,753 S 9/2006 Dirsa
D528,776 S 9/2006 Hui
D528,778 S 9/2006 Avar et al.
D529,267 S 10/2006 Portzline
D530,905 S 10/2006 Jonsson
D532,597 S 11/2006 Chan
7,162,815 B2 1/2007 Miyauchi et al.
D537,611 S 3/2007 Matis et al.
D546,532 S 7/2007 Matis et al.
D552,832 S 10/2007 Hardy
D553,837 S 10/2007 Hubbard
D553,846 S 10/2007 Kayano et al.
D555,348 S 11/2007 Bettencourt
D555,891 S 11/2007 Bettencourt
D560,061 S 1/2008 Chan
D560,062 S 1/2008 Chan
D560,063 S 1/2008 Chan
D561,985 S 2/2008 Andersen et al.
7,334,349 B2 2/2008 Sokolowski et al.
7,337,559 B2 3/2008 Russell
D569,594 S 5/2008 Horne et al.
D569,595 S 5/2008 Le
D570,078 S 6/2008 Davis
7,401,422 B1 7/2008 Scholz et al.
D574,141 S 8/2008 Kaufman
D574,581 S 8/2008 Cooper
D574,583 S 8/2008 St-Louis et al.
D574,602 S 8/2008 Grenet
D574,603 S 8/2008 McMillan
D574,604 S 8/2008 McMillan
D576,394 S 9/2008 Heller
D578,744 S 10/2008 Earle
7,441,346 B2 10/2008 Hardy et al.
D584,490 S 1/2009 Ong
D586,991 S 2/2009 Fuerst
D586,993 S 2/2009 Banik et al.
D592,383 S 5/2009 Wawrousek
D592,847 S 5/2009 Rosenbaum
D594,195 S 6/2009 Nakano
7,549,236 B2 6/2009 Dillon et al.
D595,937 S 7/2009 Morris
D596,386 S 7/2009 Brambilla
7,556,846 B2 7/2009 Dojan et al.
D599,986 S 9/2009 Reiss
D600,895 S 9/2009 Morgan
D601,334 S 10/2009 Werman
D605,838 S 12/2009 Foust

(56) References Cited

U.S. PATENT DOCUMENTS

| | | | |
|---|---|---|---|
| D607,193 | S | 1/2010 | Recchi |
| D607,633 | S | 1/2010 | Mongelli |
| 7,644,518 | B2 | 1/2010 | Chandler et al. |
| D609,440 | S | 2/2010 | Morris |
| D609,441 | S | 2/2010 | Wawrousek |
| D615,286 | S | 5/2010 | Grote |
| D615,741 | S | 5/2010 | Matis et al. |
| D616,188 | S | 5/2010 | Chan |
| 7,707,743 | B2 | 5/2010 | Schindler et al. |
| D617,085 | S | 6/2010 | Recchi et al. |
| D617,983 | S | 6/2010 | Raysse |
| 7,752,777 | B2 | 7/2010 | Hsieh |
| 7,762,008 | B1 | 7/2010 | Clark et al. |
| D622,043 | S | 8/2010 | Hauglin |
| 7,784,196 | B1 | 8/2010 | Christensen et al. |
| D624,293 | S | 9/2010 | Recchi et al. |
| 7,832,117 | B2 | 11/2010 | Auger et al. |
| 7,866,063 | B2 | 1/2011 | Caine et al. |
| 7,886,460 | B2 | 2/2011 | Teteriatnikov et al. |
| D634,922 | S | 3/2011 | Pauk et al. |
| D636,567 | S | 4/2011 | Raysse |
| D637,380 | S | 5/2011 | Niedner et al. |
| 7,946,058 | B2 | 5/2011 | Johnson et al. |
| D641,143 | S | 7/2011 | Niedner et al. |
| D641,545 | S | 7/2011 | Niedner et al. |
| D642,776 | S | 8/2011 | Raysse |
| D643,194 | S | 8/2011 | Raysse |
| 7,997,011 | B2 | 8/2011 | Smith et al. |
| D644,419 | S | 9/2011 | Raysse |
| D644,420 | S | 9/2011 | Christopherson |
| D644,824 | S | 9/2011 | Leleu |
| D646,871 | S | 10/2011 | Christopherson |
| 8,056,262 | B2 | 11/2011 | Lindqvist et al. |
| 8,056,264 | B2 | 11/2011 | Sato et al. |
| D649,753 | S | 12/2011 | Callahan et al. |
| D649,754 | S | 12/2011 | Callahan et al. |
| D651,788 | S | 1/2012 | Raysse |
| D652,201 | S | 1/2012 | Vestuti et al. |
| D653,842 | S | 2/2012 | Weiss |
| 8,112,905 | B2 | 2/2012 | Bemis et al. |
| D655,482 | S | 3/2012 | Portzline |
| D655,483 | S | 3/2012 | Portzline |
| D655,487 | S | 3/2012 | Blakeslee |
| D655,489 | S | 3/2012 | Mahoney |
| D655,897 | S | 3/2012 | Mahoney |
| D655,901 | S | 3/2012 | Raysse |
| D655,902 | S | 3/2012 | Debiase |
| D656,715 | S | 4/2012 | Katz et al. |
| D656,720 | S | 4/2012 | Wawrousek |
| D657,542 | S | 4/2012 | Duan |
| D657,944 | S | 4/2012 | Casadei |
| 8,146,266 | B2 | 4/2012 | Vattes et al. |
| D659,356 | S | 5/2012 | Van Zyll De Jong et al. |
| D659,362 | S | 5/2012 | Van Zyll De Jong et al. |
| D659,958 | S | 5/2012 | Birkinhead |
| D659,959 | S | 5/2012 | Vestuti et al. |
| D659,964 | S | 5/2012 | Callahan et al. |
| D659,965 | S | 5/2012 | Callahan et al. |
| D660,568 | S | 5/2012 | Blakeslee |
| 8,181,365 | B2 | 5/2012 | Cass et al. |
| D661,476 | S | 6/2012 | Loverin |
| D661,879 | S | 6/2012 | Raysse |
| D661,880 | S | 6/2012 | Raysse |
| D662,293 | S | 6/2012 | Christopherson |
| D662,295 | S | 6/2012 | Raysse |
| D662,301 | S | 6/2012 | Raysse |
| D662,697 | S | 7/2012 | Portzline |
| D662,699 | S | 7/2012 | Callahan et al. |
| D662,700 | S | 7/2012 | Raysse |
| D663,929 | S | 7/2012 | Teng-Lee |
| D666,390 | S | 9/2012 | Van Zyll De Jong et al. |
| D667,204 | S | 9/2012 | Campbell et al. |
| D667,617 | S | 9/2012 | Spring |
| D667,618 | S | 9/2012 | Raysse |
| D668,028 | S | 10/2012 | Pope |
| D668,029 | S | 10/2012 | Vestuti et al. |
| D669,255 | S | 10/2012 | Birkinhead |
| D674,581 | S | 1/2013 | Callahan et al. |
| D674,996 | S | 1/2013 | Sallee |
| 8,984,775 | B2 | 3/2015 | Dombrow et al. |
| 2001/0008053 | A1 | 7/2001 | Belli |
| 2003/0101621 | A1 | 6/2003 | Nishiwaki et al. |
| 2004/0154189 | A1 | 8/2004 | Wang |
| 2006/0137227 | A1 | 6/2006 | Kita et al. |
| 2006/0277792 | A1 | 12/2006 | Schoenborn |
| 2006/0283045 | A1 | 12/2006 | Kita et al. |
| 2007/0209230 | A1 | 9/2007 | Dillon et al. |
| 2007/0266593 | A1 | 11/2007 | Schindler et al. |
| 2008/0052965 | A1 | 3/2008 | Sato |
| 2008/0066347 | A1 | 3/2008 | Suzuki |
| 2008/0120871 | A1 | 5/2008 | Sato et al. |
| 2008/0229617 | A1 | 9/2008 | Johnson et al. |
| 2008/0276491 | A1 | 11/2008 | Gaensler et al. |
| 2008/0289224 | A1 | 11/2008 | Sink |
| 2009/0013559 | A1 | 1/2009 | Chan et al. |
| 2010/0175280 | A1 | 7/2010 | Rinehart et al. |
| 2010/0192420 | A1 | 8/2010 | Favraud |
| 2010/0242304 | A1* | 9/2010 | Reilly ..... A43B 7/142 36/88 |
| 2010/0269376 | A1 | 10/2010 | Flannery et al. |
| 2010/0325917 | A1 | 12/2010 | Cass et al. |
| 2011/0016749 | A1 | 1/2011 | Callahan et al. |
| 2011/0232130 | A1 | 9/2011 | Boudreau et al. |
| 2011/0277351 | A1 | 11/2011 | Scoledes |
| 2011/0289799 | A1 | 12/2011 | Keating et al. |
| 2012/0000095 | A1 | 1/2012 | Torrance |
| 2012/0055047 | A1 | 3/2012 | Youngs |
| 2012/0073160 | A1 | 3/2012 | Marvin et al. |
| 2012/0167416 | A1 | 7/2012 | Christensen et al. |

FOREIGN PATENT DOCUMENTS

| | | | |
|---|---|---|---|
| EP | 1064861 | A1 | 1/2001 |
| EP | 2277402 | A2 | 1/2011 |
| JP | 11000203 | A | 1/1999 |
| JP | 11235202 | A | 8/1999 |
| JP | 2001275711 | A | 10/2001 |
| JP | 2002336003 | A | 11/2002 |
| JP | 2003339405 | A | 12/2003 |
| JP | 2004173884 | A | 6/2004 |
| JP | 2004267516 | A | 9/2004 |
| JP | 2005253578 | A | 9/2005 |
| WO | WO9109547 | A1 | 7/1991 |

OTHER PUBLICATIONS

K-Swiss, Inc. Online Store—Tubes Run 100A, http://www.kswiss.com/item/201.200/02316-162/Men/Footwear_Running/Tubes_Run_100_A/Wht_Blk_Sunorng.html (visited on Oct. 2, 2009), 2 pages.

Reebok Blast shoe, http://img187.imageshack.us/img187/1264/reebokblasteg0.jpg, release date 1995, 1 page.

Extended European Search Report for Application No. EP 11194626.5, Applicant: Reebok International Limited, dated May 8, 2012, 6 pages.

English language abstract of JP 11235202 A, espacenet database, Worldwide, published Aug. 31, 1999.

English language abstract of JP 2001275711 A, espacenet database, Worldwide, published Oct. 9, 2001.

English language abstract of JP 2002336003 A, espacenet database, Worldwide, published Nov. 26, 2002.

English language abstract of JP 2003339405 A, espacenet database, Worldwide, published Dec. 2, 2003.

English language abstract of JP 2004173884 A, espacenet database, Worldwide, published Jun. 24, 2004.

English language abstract of JP 2004267516 A, espacenet database, Worldwide, published Sep. 30, 2004.

English language abstract of JP 2005253578 A, espacenet database, Worldwide, published Sep. 22, 2005.

U.S. Appl. No. 29/345,964, Christopher S. Pope, "Shoe and Portion of a Shoe", filed Oct. 23, 2009.

(56) References Cited

OTHER PUBLICATIONS

U.S. Appl. No. 12/980,961, Brian Christensen, "Sole and Article of Footwear", filed Dec. 29, 2010.
U.S. Appl. No. 29/411,762, Hardigan et al., "Portion of a Shoe Sole", filed Jan. 25, 2012.
U.S. Appl. No. 29/416,617, Davis et al., "Portion of a Shoe", filed Mar. 23, 2012.
U.S. Appl. No. 13/428,897, Davis et al., "Articles of Footwear", filed Mar. 23, 2012.
U.S. Appl. No. 29/418,772, Vestuti et al., "Portion of a Shoe", filed Apr. 20, 2012.
U.S. Appl. No. 29/419,638, Birkinhead, "Portion of a Shoe", filed Apr. 30, 2012.
U.S. Appl. No. 29/419,900, Callahan et al., "Portion of a Shoe", filed May 2, 2012.
U.S. Appl. No. 29/419,905, Callahan et al., "Portion of a Shoe", filed May 2, 2012.
U.S. Appl. No. 29/433,384, Christopher S. Pope, "Shoe", filed Sep. 28, 2012.
U.S. Appl. No. 29/443,384, Callahan et al., "Shoe Sole", filed Jan. 16, 2013.

* cited by examiner

ARTICLES OF FOOTWEAR

BACKGROUND

Field of the Invention

The present invention relates to footwear.

Background

Individuals can be concerned with the amount of cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole functions, in part, to provide cushioning to the wearer's foot and to protect it from these forces. To achieve adequate cushioning, many footwear soles are thick and heavy. When sole size and/or weight are reduced to achieve other performance goals, protection of the wearer's foot is often compromised.

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing shoes that provide proper cushioning, support, and flexibility, the soreness and fatigue associated with every day activity is more acute, and its onset accelerated. The discomfort for the wearer that results may diminish the incentive for further activity. Also, inadequate cushioning, support, or flexibility in an article of footwear can lead to injuries such as blisters; muscle, tendon and ligament damage; and bone stress fractures. Improper footwear can also lead to other ailments, including back pain.

BRIEF SUMMARY

Proper footwear should complement the natural functionality of the foot, in part by incorporating a sole that absorbs shocks. Therefore, a continuing need exists for innovations in providing cushioning, support, and flexibility to articles of footwear. At least some embodiments of the present invention satisfy the above needs and provide further related advantages as will be made apparent by the description that follows.

Some embodiments of the present invention provide a sole for an article of footwear, the sole including a fiber-reinforced polymer plate extending from a heel area of the article of footwear to a toe area of the article of footwear, wherein flexibility of the fiber-reinforced polymer plate varies as a function of location along a longitudinal axis of the fiber-reinforced polymer plate, and wherein the fiber-reinforced polymer plate includes a stiffening layer disposed at a midfoot area of the fiber-reinforced polymer plate.

Some embodiments of the present invention provide a sole for an article of footwear wherein flexibility of a forefoot area of the fiber-reinforced polymer plate is greater than flexibility of a midfoot area of the fiber-reinforced polymer plate.

Some embodiments of the present invention provide a sole for an article of footwear wherein flexibility of a forefoot area of the article of footwear is greater than flexibility of a midfoot area of the article of footwear.

Some embodiments of the present invention provide a sole for an article of footwear wherein the stiffening layer includes unidirectional fiber tape having fibers oriented parallel to the longitudinal axis.

Some embodiments of the present invention provide a sole for an article of footwear wherein the forefoot area of the fiber-reinforced polymer plate is resilient.

Some embodiments of the present invention provide a sole for an article of footwear wherein resilience of the forefoot area promotes a spring effect upon transitioning from a bent state to an un-bent state.

Some embodiments of the present invention provide a sole for an article of footwear wherein a forefoot area of fiber-reinforced polymer plate is configured to transition from a neutral state to a bent state and from the bent state to the neutral state, in response to a wearer's gait cycle.

Some embodiments of the present invention provide a sole for an article of footwear, the sole including a fiber-reinforced polymer plate extending from a heel area of the article of footwear to a toe area of the article of footwear; and a midsole support coupled to the fiber-reinforced polymer plate, wherein the midsole support extends around a peripheral edge of the fiber-reinforced polymer plate, and wherein a continuous portion of the midsole support covers two portions of the peripheral edge spaced apart by an uncovered portion of the peripheral edge.

Some embodiments of the present invention provide a sole for an article of footwear wherein the midsole support defines a serpentine shape along the peripheral edge of the fiber-reinforced polymer plate, and wherein the midsole support extends above and below the fiber-reinforced polymer plate.

Some embodiments of the present invention provide a sole for an article of footwear wherein the midsole support is coupled to a bottom surface of the fiber-reinforced polymer plate, wherein a portion of the bottom surface of the fiber-reinforced polymer plate is uncovered by the midsole support, and wherein the uncovered portion of the bottom surface of the fiber-reinforced polymer plate define a serpentine area disposed in a forefoot area of the fiber-reinforced polymer plate.

Some embodiments of the present invention provide a sole for an article of footwear wherein the midsole support includes a forward midsole support element continuously extending around the peripheral edge of the fiber-reinforced polymer plate at a forefoot area of the fiber-reinforced polymer plate, wherein the midsole support includes a rearward midsole support element continuously extending around peripheral edge of the fiber-reinforced polymer plate at a rearfoot area of the fiber-reinforced polymer plate, and wherein the forward midsole support element and the rearward midsole support element are spaced apart on a medial and a lateral side of the fiber-reinforced polymer plate at a midfoot area of the fiber-reinforced polymer plate.

Some embodiments of the present invention provide a sole for an article of footwear including a thermoplastic layer disposed on a bottom surface of the fiber-reinforced polymer plate, wherein the thermoplastic layer includes a base thickness and a raised pattern having a thickness greater than the base thickness.

Some embodiments of the present invention provide a sole for an article of footwear wherein the raised pattern corresponds to an interior border of the midsole support where the midsole support meets the fiber-reinforced polymer plate.

Some embodiments of the present invention provide a sole for an article of footwear wherein the midsole support is adhered to the fiber-reinforced polymer plate by adhesive disposed along the elongate raised pattern.

Some embodiments of the present invention provide a sole for an article of footwear, the sole including a fiber-reinforced polymer plate extending from a heel area of the article of footwear to a toe area of the article of footwear, wherein the fiber-reinforced polymer plate includes a plurality of first fibers, the first fibers extending parallel to each other; and a plurality of second fibers, the second fibers extending parallel to each other; and a midsole support coupled to the fiber-reinforced polymer plate, wherein the plurality of first fibers is woven with the plurality of second fibers, wherein the plurality of first fibers is oriented at an oblique angle with respect to a longitudinal axis of the article of footwear, wherein the plurality of second fibers is oriented perpendicularly to the plurality of first fibers, wherein the midsole support extends around a peripheral edge of the fiber-reinforced polymer plate, and wherein the fiber-reinforced polymer plate includes a stiffening layer of unidirectional fiber tape disposed at a midfoot area of the article of footwear.

Some embodiments of the present invention provide a sole for an article of footwear wherein the fiber-reinforced polymer plate includes carbon fiber.

Some embodiments of the present invention provide a sole for an article of footwear wherein the fiber-reinforced polymer plate includes glass fiber.

Some embodiments of the present invention provide a sole for an article of footwear, the sole including a fiber-reinforced polymer plate; and a midsole support extending around a periphery of a bottom surface of the fiber-reinforced polymer plate, in a forefoot area of the fiber-reinforced polymer plate, wherein an interior border of the midsole support defines a serpentine shape.

Some embodiments of the present invention provide a sole for an article of footwear wherein a portion of the fiber-reinforced polymer plate is exposed between opposing portions of the midsole support in the forefoot area.

Some embodiments of the present invention provide a sole for an article of footwear wherein a serpentine-shaped portion of the fiber-reinforced polymer plate is exposed and is defined by the interior border of the midsole support.

Some embodiments of the present invention provide a sole for an article of footwear wherein the midsole support includes first inward projections that project inward from a medial side of the periphery of the bottom surface of the fiber-reinforced polymer plate, wherein the midsole support includes second inward projections that project inward from a lateral side of the periphery of the bottom surface of the fiber-reinforced polymer plate.

Some embodiments of the present invention provide a sole for an article of footwear wherein the first inward projections extend between the second inward projections.

Additional features of embodiments of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE FIGURES

The accompanying figures, which are incorporated herein, form part of the specification and illustrate embodiments of the present invention. Together with the description, the figures further serve to explain the principles of and to enable a person skilled in the relevant arts to make and use the invention.

DETAILED DESCRIPTION

Figure 1:
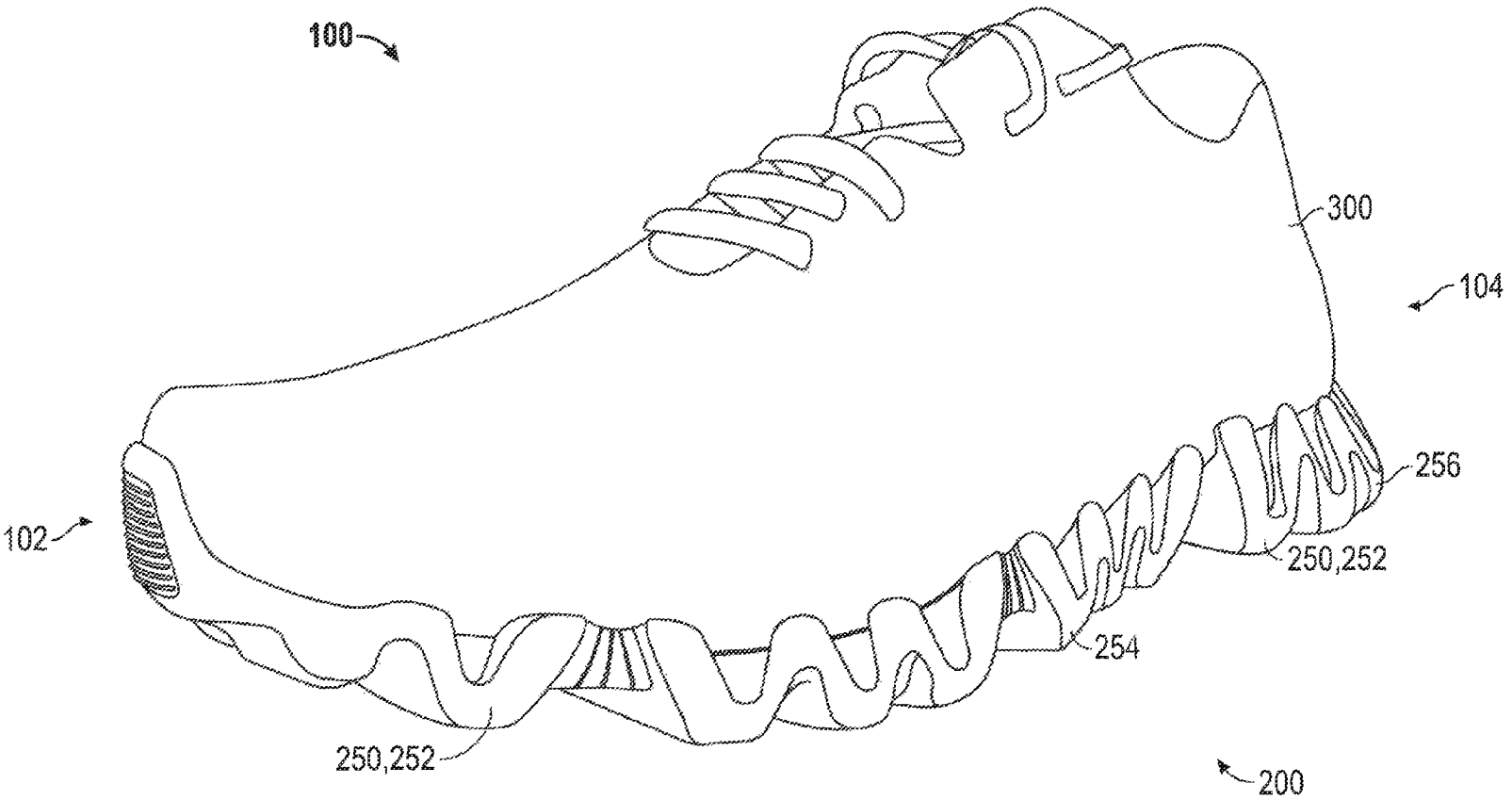
FIG. 1 illustrates a perspective view of an article of footwear, according to an embodiment presented herein.

Embodiments of the present invention will now be described in detail with reference to embodiments thereof as illustrated in the accompanying drawings, in which like reference numerals are used to indicate identical or functionally similar elements. References to "one embodiment", "an embodiment", "some embodiments", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention are directed to a variety of objectives, including, but not limited to, minimizing the weight of an article of footwear; controlling the flexion, resilience, and support of an article of footwear; and minimizing the potential for failure of a fiber-reinforced polymer plate of an article of footwear.

An article of footwear according to embodiments of the present invention may include a sole having a composite fiber-reinforced polymer plate (e.g., a carbon fiber, glass fiber, aluminized glass fiber, or aluminized carbon fiber plate). Such a fiber-reinforced polymer plate can contribute to a lesser weight of the article of footwear than some conventional articles of footwear not having a fiber-reinforced polymer plate, while still providing support to a wearer of the article of footwear. The fiber-reinforced polymer plate can be sufficiently flexible and resilient to facilitate bending of the sole and article of footwear and returning (un-bending) in response to a wearer's gait cycle. For example, the fiber-reinforced polymer plate may be configured to transition from a neutral (un-bent) state to a bent state and from the bent state to the neutral state, in response to forces applied during a wearer's gait cycle.

The fiber-reinforced polymer plate can have flexibility and resilience characteristics to promote bending and returning (un-bending to return toward the original state) in some areas more or less than in other areas, to tailor the flexibility and resilience as desired (e.g., to compliment a wearer's gait). For example, the fiber-reinforced polymer plate may be relatively rigid in an arch area (i.e., more rigid in an arch area than in other areas), and may be relatively flexible in a forefoot area and/or rearfoot area (i.e., more flexible in a forefoot area and/or rearfoot area than in other areas). In some embodiments, the fiber-reinforced polymer plate may also be resilient in the forefoot and/or rearfoot area. Such flexibility and resilience characteristics can help provide support for the arch of a wearer's foot, while also bending and returning to accommodate natural foot motion during a gait cycle, for example at the toe joints (e.g., the metatarsophalangeal joints) during toe-off. The resilience of the fiber-reinforced polymer plate may promote a spring effect (i.e., may impart a force tending to un-bend when bent) upon transitioning from a bent state to an un-bent state (e.g., during toe-off). Such a spring effect can provide a variety of benefits to a wearer, for example, facilitating natural foot motion, and increasing maximum jump height and running speed.

In some embodiments, an article of footwear 100 includes a sole 200 and an upper 300 (see, e.g., FIGS. 1-7). Article of footwear 100 may include a toe area 102 and a heel area 104. Sole 200 includes a midsole plate 210 and midsole support 250.

In some embodiments, midsole plate 210 may extend over substantially all of the forefoot, midfoot, and rearfoot of article of footwear 100, from toe area 102 to heel area 104. Midsole plate 210 can have constant or varying support, resilience, and flexibility, and can affect the support, resilience, and flexibility of article of footwear 100. For example, the longitudinal flexibility of midsole plate 210 may be different at different points or areas along its longitudinal axis 10 (see, e.g., FIGS. 18 and 19). In some embodiments, midsole plate 210 is resilient such that when bent (e.g., in areas of relatively higher flexibility (i.e., areas having greater flexibility than other areas)) midsole plate applies a restoring resilient force in opposition to the applied force causing the bending. Upon removal of the applied force, the restoring resilient force may cause midsole plate 210 to return to an un-bent (neutral) state. The restoring force may also cause the aforementioned spring effect as it returns midsole plate 210 to the neutral state.

In some embodiments, midsole plate 210 (and article of footwear 100 generally) can include a forefoot area 212, a midfoot area 214, and a rearfoot area 216 (see, e.g., FIGS. 8, 12, 18, and 19).

In some embodiments, midfoot area 214 of midsole plate 210 may have lesser longitudinal flexibility (i.e., greater stiffness) than either of forefoot area 212 and rearfoot area 216 of midsole plate 210. Flexion zones can be formed in areas of relatively higher flexibility adjacent to areas of relatively lower flexibility (e.g., midsole plate flexion zones 218, 220), and can bend more readily than the areas of relatively lower flexibility, due to their higher flexibility (i.e., flexion zones can be formed in areas of midsole plate 210 having greater flexibility than other areas of midsole plate 210). Flexion zones can also be resilient such that they impart a resilient force tending toward a straight (neutral) configuration when bent.

Foot anatomy can vary from wearer to wearer, so a zone of flexibility can be tailored to encompass an area large enough to accommodate a variety of foot anatomies. For example, a wearer's foot will typically bend at his or her metatarsophalangeal joints during a typical gait cycle, and it may be desired that article of footwear 100 bend correspondingly. The position and alignment of potential wearers' metatarsophalangeal joints can vary widely, and so a zone of flexibility can be tailored (e.g., sized, shaped, positioned) to accommodate such variation.

Figure 18:
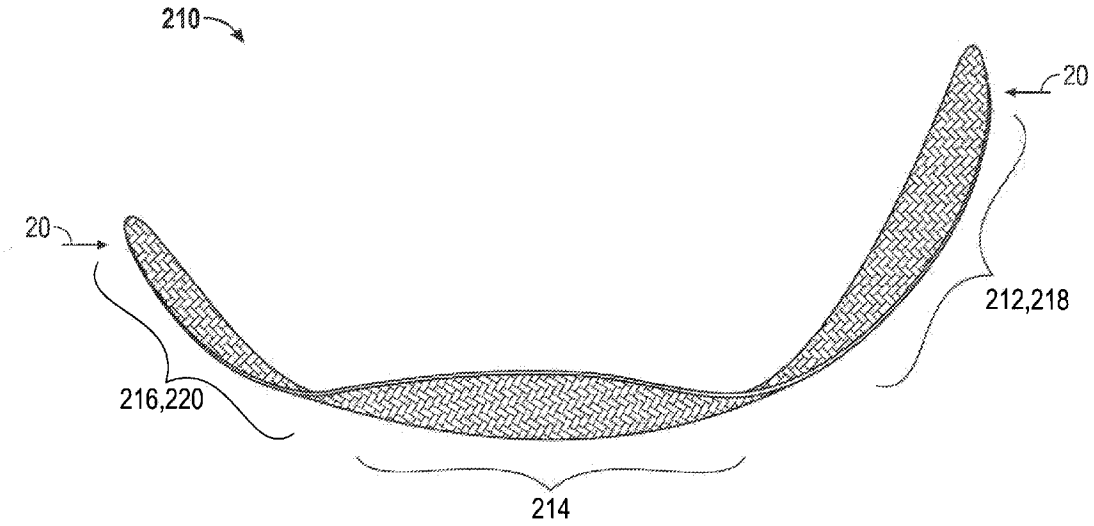
FIG. 18 illustrates a medial side view of a midsole plate applied with a force, according to an embodiment presented herein.
Figure 19:
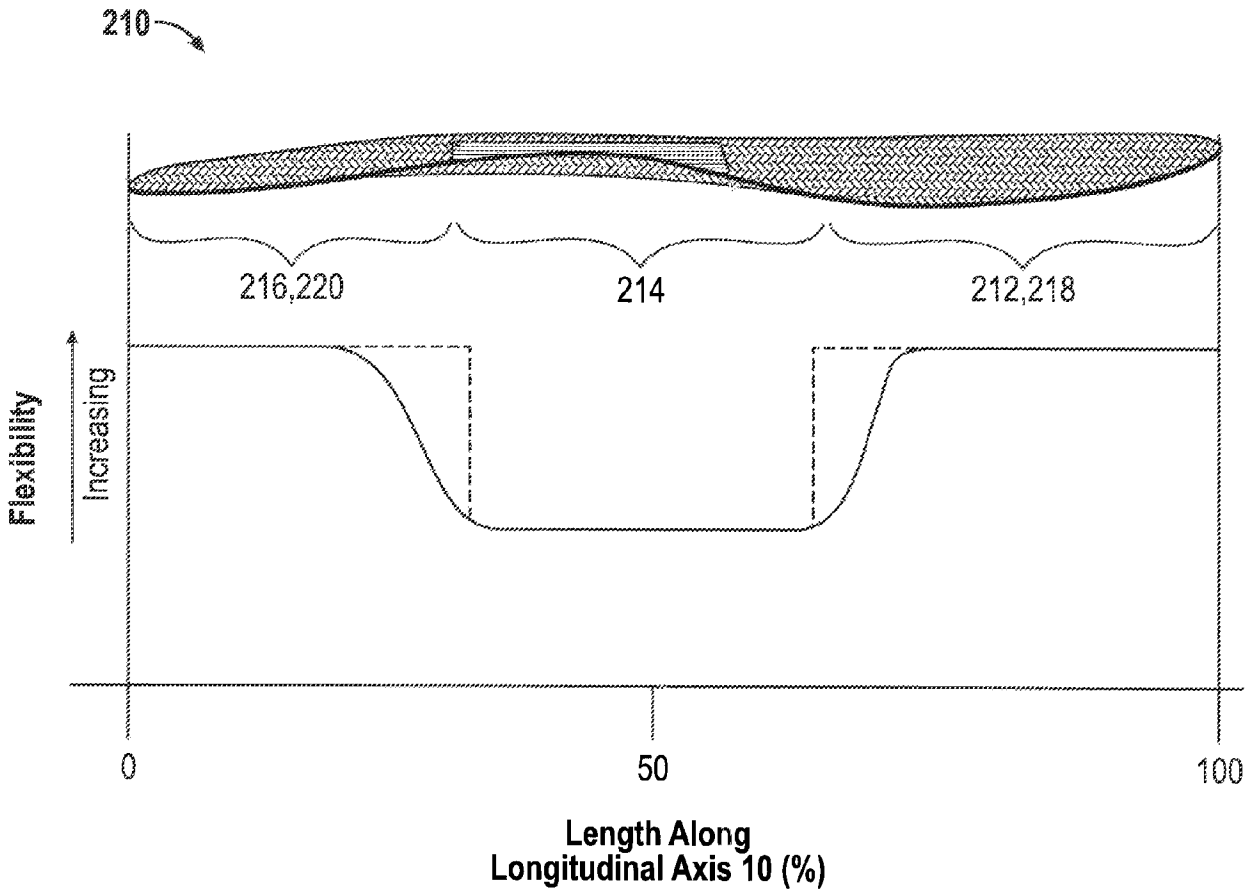
FIG. 19 is a graph representing flexibility of a midsole plate, according to an embodiment presented herein.

FIG. 18, for example, illustrates midsole plate 210 applied with an inward force 20, which is applied equally to both forefoot area 212 and rearfoot area 216. Inward force 20 may be opposed by a resilient force, which may provide the aforementioned spring effect upon unbending (e.g., upon removal of inward force 20). Midsole plate 210 substantially maintains its form along areas of lesser flexibility (e.g., midfoot area 214 in FIG. 18), and bends in areas of greater flexibility (e.g., forefoot area 212 and rearfoot area 216 in FIG. 18, corresponding to flexion zones 218 and 220, respectively). FIG. 19 provides an exemplary graphical representation of the flexibility of midsole plate 210, having relatively lower flexibility in midfoot area 214, and relatively higher flexibility in forefoot area 212 and rearfoot area 216 (i.e., the flexibility in midfoot area 214 is lower than the flexibility in forefoot area 212 and rearfoot area 216). As shown in FIG. 19, flexibility can increase or decrease between areas of higher and lower flexibility. Such increase/decrease can be gradual (shown by the solid line) or abrupt, as in a step function (shown by the broken line). In either case, a flexion zone can be formed beginning at the transition. The characteristics of the increase/decrease can be affected by, for example, material, orientation of material elements (e.g., material fibers), comparative flexibility and position of layers of midsole plate 210, inclusion of stiffening elements or material, three-dimensional shape (e.g., medial curve 206, lateral curve 208), thickness, inclusion of support elements, and inclusion of a coating surrounding all or a portion of midsole plate 210 with one or more layers of material (e.g., rubber or plastic such as, for example, polyurethane (including thermoplastic polyurethane)), which may be, for example, injection-molded to the plate, and which may have constant or varying properties (e.g., thickness, number of layers, material of layers, flexibility) along the surface of plate 210.

The flexibility profile of a midsole plate and that of its article of footwear can be adjusted using techniques described herein independently or in combination or in conjunction with those that would be apparent to one of skill in the art, to position flexion zones having desired characteristics at desired location(s) in the midsole plate and/or article of footwear. The relative flexibility of flexion zones (i.e., the greater flexibility of flexion zones compared to other areas of midsole plate 210 or article of footwear 100) can facilitate the accommodation of variations in wearer anatomy, and can allow for independent movement of portions of a wearer's foot where desired (e.g., bending at the metatarsophalangeal joints). The relative stiffness of other portions of midsole plate 210 and/or article of footwear 100 (i.e., the greater stiffness of other portions of the midsole plate 210 and/or article of footwear 100 compared to flexion zones) can provide support and limit relative movement of portions of a wearer's foot where desired (e.g., at the midfoot area of a wearer's foot, including the arch).

The flexibility of midsole plate 210 can be affected by a variety of factors, such as, for example, material, orientation of material elements (e.g., material fibers), comparative flexibility and position of layers of midsole plate 210, inclusion of stiffening elements or material, three-dimensional shape (e.g., medial curve 206, lateral curve 208), thickness, inclusion of support elements, and inclusion of a coating surrounding all or a portion of midsole plate 210 with one or more layers of material (e.g., rubber or plastic such as, for example, polyurethane (including thermoplastic polyurethane)), which may be, for example, injection-molded to the plate, and which may have constant or varying properties (e.g., thickness, number of layers, material of layers, flexibility) along the surface of plate 210.

In some embodiments, midsole plate 210 is formed of at least one layer including a plurality of fibers, which can be overlaid, woven together (for example, in a twill weave), or positioned only in parallel (uni-directional). For example, midsole plate 210 can be formed of a fiber-reinforced polymer to form a fiber-reinforced polymer plate. Suitable fiber-reinforced polymers are manufactured by BAYCOMP, a subsidiary of PERFORMANCE MATERIALS CORPORATION, as Continuous Fiber Reinforced Thermoplastic (CFRT®). Such a fiber midsole plate 210 can have fibers extending in one or more directions—for example, one or more layers of fibers extending parallel to each other in a single direction (i.e., uni-directional), and/or one or more layers of fibers extending in two directions (e.g., oriented at 90 degrees to each other).

Figure 16:
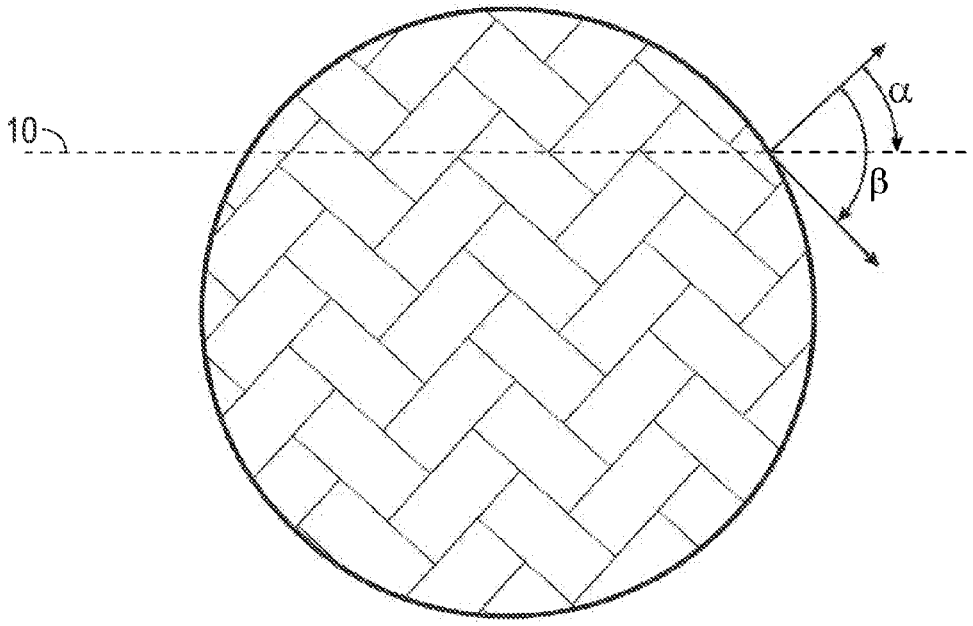
FIG. 16 illustrates an enlarged view of portion of a midsole plate, according to an embodiment presented herein.

In some embodiments, fibers extending in different directions can be woven together, for example, in a plain weave, a satin weave, or a twill weave (e.g., a 2-by-2 twill weave, as shown in, for example, FIG. 16). Fiber midsole plate 210 can be thermoplastic or non-thermoplastic (e.g., thermoset). The fibers can all be the same type (e.g., carbon, glass, aluminized glass, aluminized carbon, nylon, Kevlar, metal) or can include fibers of more than one type (e.g., 70% carbon fiber/30% glass fiber, 60% carbon fiber/30% glass fiber). In some embodiments, first fibers (of a first type) extend in a first direction, and second fibers (which may be of the first type or of a second, different type) extend in a second direction (e.g., 90 degrees to the first fiber direction). For example, carbon fibers may extend in one direction, and glass fibers may be interwoven with the carbon fibers and may extend perpendicularly to the carbon fibers. In some embodiments, fibers of different types can extend in the same direction and be woven with other fibers of the same or different types. For example, a first set of alternating carbon and glass fibers may extend in one direction, and may be interwoven with a second set of alternating carbon and glass fibers, extending perpendicularly to the first set. Construction of midsole plate 210 can be tailored to have desired characteristics. For example, midsole plate 210 may be constructed of a variety of layers having fibers in a variety of orientations, in order to achieve desired characteristics (e.g., desired flexibility and resilience).

In some embodiments, the fibers of midsole plate 210 are impregnated with suitable resins (e.g., polyester resins, epoxy resins, and/or hybridized thermoplastic resins, which may or may not be coupled with one or more exterior layers, such as, for example, thermoplastic polyurethane (TPU), nylon, or rubber). Such exterior layer(s) can have a variety of characteristics. For example, the exterior layer(s) may have varying thickness, may cover all or a portion of midsole plate 210, and/or may carry a color, graphic, or other aesthetic element.

The material flexibility of midsole plate 210 can impact the overall flexibility of midsole plate 210 (and sole 200 of article of footwear 100 into which it is incorporated). For example, carbon fibers may impart greater stiffness to midsole plate 210 than glass fibers. So a midsole plate 210 formed of glass fibers may be more flexible than one of similar construction formed of carbon fibers, and a midsole plate formed of both glass fibers and carbon fibers may be more flexible in the direction of the glass fibers than in the direction of the carbon fibers.

Fibers of midsole plate 210 can impart the greatest stiffness in the direction they extend. Thus, orienting fibers of midsole plate 210 differently about the same axis can result in different flexibility along that axis, as well as different torsional stability. In some embodiments having two sets of fibers woven together and extending at an angle $\beta$ of about (i.e., within a range of +/−2 degrees) 90 degrees to each other, one set of fibers can be oriented at an angle $\alpha$ oblique to a longitudinal axis 10 of midsole plate 210 (see e.g., FIG. 16). In some embodiments, angle $\alpha$ may be about (i.e., within a range of +/−2 degrees) 35 degrees (positive or negative). This orientation has been found to provide suitable forefoot flexibility and resilience, medial-lateral flexibility, torsional stability, and resistance to failure (e.g., crack formation and propagation). Longitudinal axis 10 is an axis extending parallel to the lateral side of midsole plate 210 (i.e., an axis extending parallel to a line defining a tangent with the lateral side of both forefoot area 212 and rearfoot area 216) in a top view.

In some embodiments, one or more layers of midsole plate 210 extend over all of midsole plate 210 (i.e., to define a peripheral edge 242 of midsole plate 210). In some embodiments, one or more layers of midsole plate 210 extend over a limited area of midsole plate 210. For example, a limited fiber layer can be formed at a location at which and orientation in which greater stiffness is desired. The position and orientation of such a layer can affect the overall flexibility profile of midsole plate 210. For example, a stiffening layer 222 (see, e.g., FIGS. 8, 9, 12, and 13) can be provided at midfoot area 214 of midsole plate 210. In some embodiments, stiffening layer 222 may be formed of uni-directional carbon fibers (e.g., uni-directional carbon fiber tape), which may be oriented parallel to longitudinal axis 10 of midsole plate 210. In some embodiments, stiffening layer 222 may be formed of, for example, one or more of uni-directional carbon fibers, resin, plastic (e.g., injected plastic, polyurethane, thermoplastic polyurethane), and metal. Such a configuration could provide increased stiffness at midfoot area 214, while allowing forefoot area 212 and/or rearfoot area 216 to remain relatively flexible (i.e., more flexible than midfoot area 214). Uni-directional carbon fiber material such as uni-directional carbon fiber tape can provide a high stiffness-to-weight ratio compared to traditional stiffening material, such as molded non-fibrous plastic, and can be beneficial in providing controlled stiffness to areas of midsole plate 210 while contributing minimal weight.

In some embodiments, midsole plate 210 is formed of a substantially flat construction that has been molded to impart a non-flat three-dimensional shape to portions of midsole plate 210. The shape of midsole plate 210 can affect its flexibility profile. For example, radii or other bends (e.g., medial curve 206 and lateral curve 208) can be formed in midsole plate 210 to increase stiffness in the direction of the bending axis. Such bends can impart stiffness in midsole plate 210 in areas that would otherwise be flexible. Due in part to its fibrous construction, such bends may impart stiffness in a fiber-reinforced polymer midsole plate 210 to a greater extent than similar bends would impart to a plastic, non-fibrous, plate. In this manner, in some embodiments midsole plate 210 may provide spring and support/stiffening effects in the same plate, without contributing additional mass to midsole plate 210.

Figure 17:
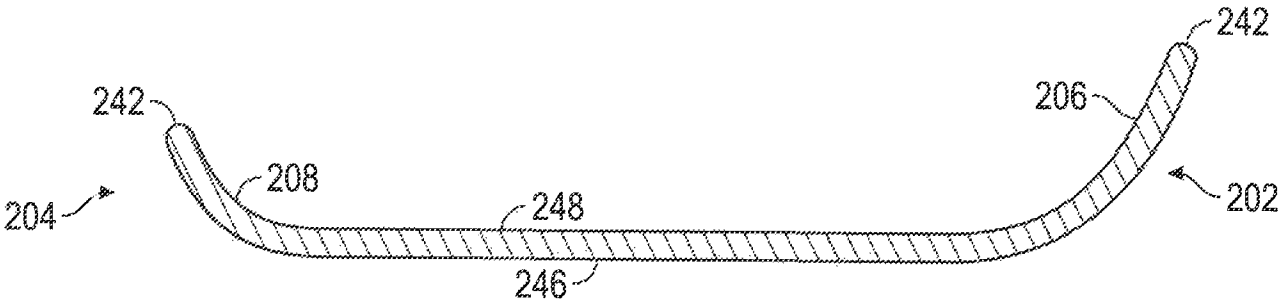
FIG. 17 illustrates a section view of a midsole plate, taken along line 17-17 of FIG. 9, according to an embodiment presented herein.

The radii can be formed to increase or decrease gradually, causing stiffness to increase or decrease gradually, respectively. In some embodiments, edge portions of midsole plate 210 along midfoot area 214 can be turned up to form radii (e.g., a medial curve 206 and/or a lateral curve 208) along portions of peripheral edge 242, as shown, for example, in FIG. 17, which is a cross-sectional view taken along line 17-17 of FIG. 9. For simplicity, layers of midsole plate 210 are not shown in FIG. 17. In some embodiments, a medial curve 206 can be formed at medial side 202 and midfoot area 214 of midsole plate 210, and a lateral curve 208 can be formed at lateral side 204 and midfoot area 214 of midsole plate 210. This configuration can provide increased longitudinal stiffness in midfoot area 214 of midsole plate 210. In some embodiments, edge portions of midsole plate 210 along forefoot area 212 and rearfoot area 216 are not turned up, in order to maintain their flexibility.

Other three-dimensional shaped portions can be formed in midsole plate 210. For example, forefoot area 212 can be formed concave (when viewed from the top) to conform to the shape of a forward area of a foot. This configuration can limit the direction of flexibility of midsole plate 210 in forefoot area 212 by impeding downward flexing, but allowing upward flexing. Such a configuration may be desirable to allow upward flexing at the metatarsophalangeal joint to correspond to the shape of a wearer's foot during toe-off, and to help prevent a wearer's foot from flexing oppositely downward at the metatarsophalangeal joint. Also for example, rearfoot area 216 can be formed concave (when viewed from the top) to conform to the shape of a rearward area of a foot. This configuration can limit the direction of flexibility of midsole plate 210 in rearfoot area 216 by impeding downward flexing, but allowing upward flexing. Such a configuration may be desirable to maintain comfortable and supportive contact with a wearer's foot. Also for example, rearfoot area 216 can be formed convex (when viewed from the top) to provide additional cushioning to the rearward area of a foot. This configuration can allow rearfoot area 216 to act as a cushioning spring, deflecting downward in response to force applied via a wearer's heel, and applying an upward force to the wearer's heel to support and cushion the wearer's heel, and to promote upward motion of the wearer's heel.

Figure 11:
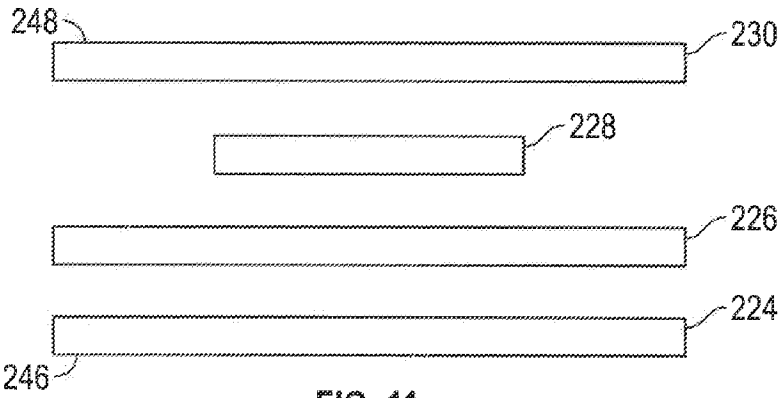
FIG. 11 illustrates an exploded view of a midsole plate, according to an embodiment presented herein.
Figure 12:
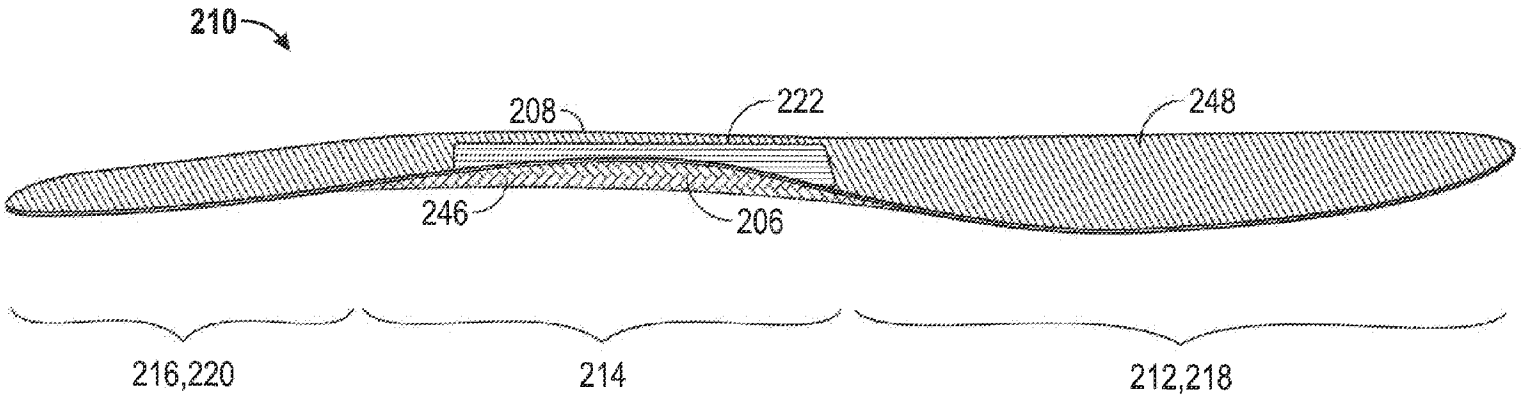
FIG. 12 illustrates a medial side view of a midsole plate, according to an embodiment presented herein.
Figure 13:
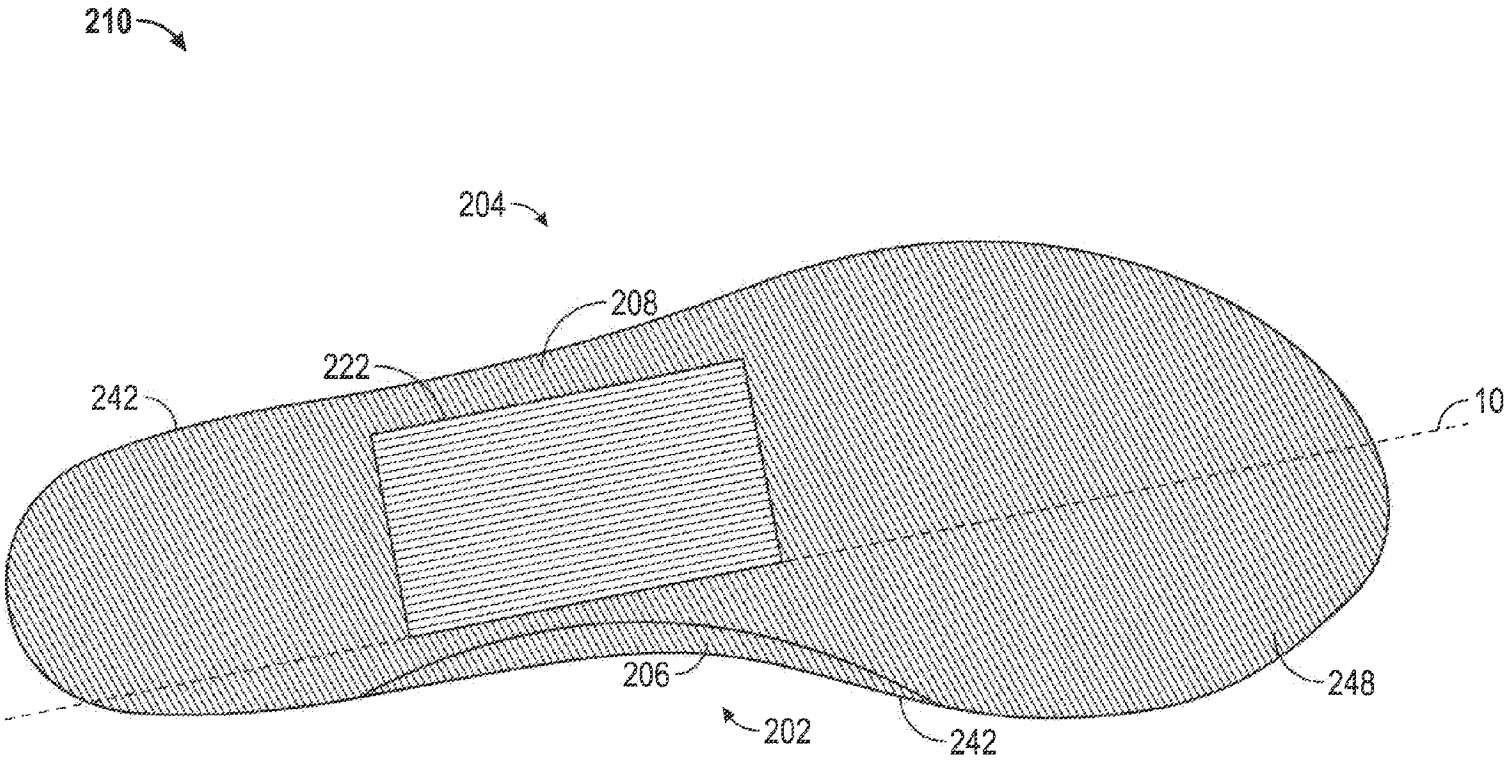
FIG. 13 illustrates a top view of a midsole plate, according to an embodiment presented herein.
Figure 14:
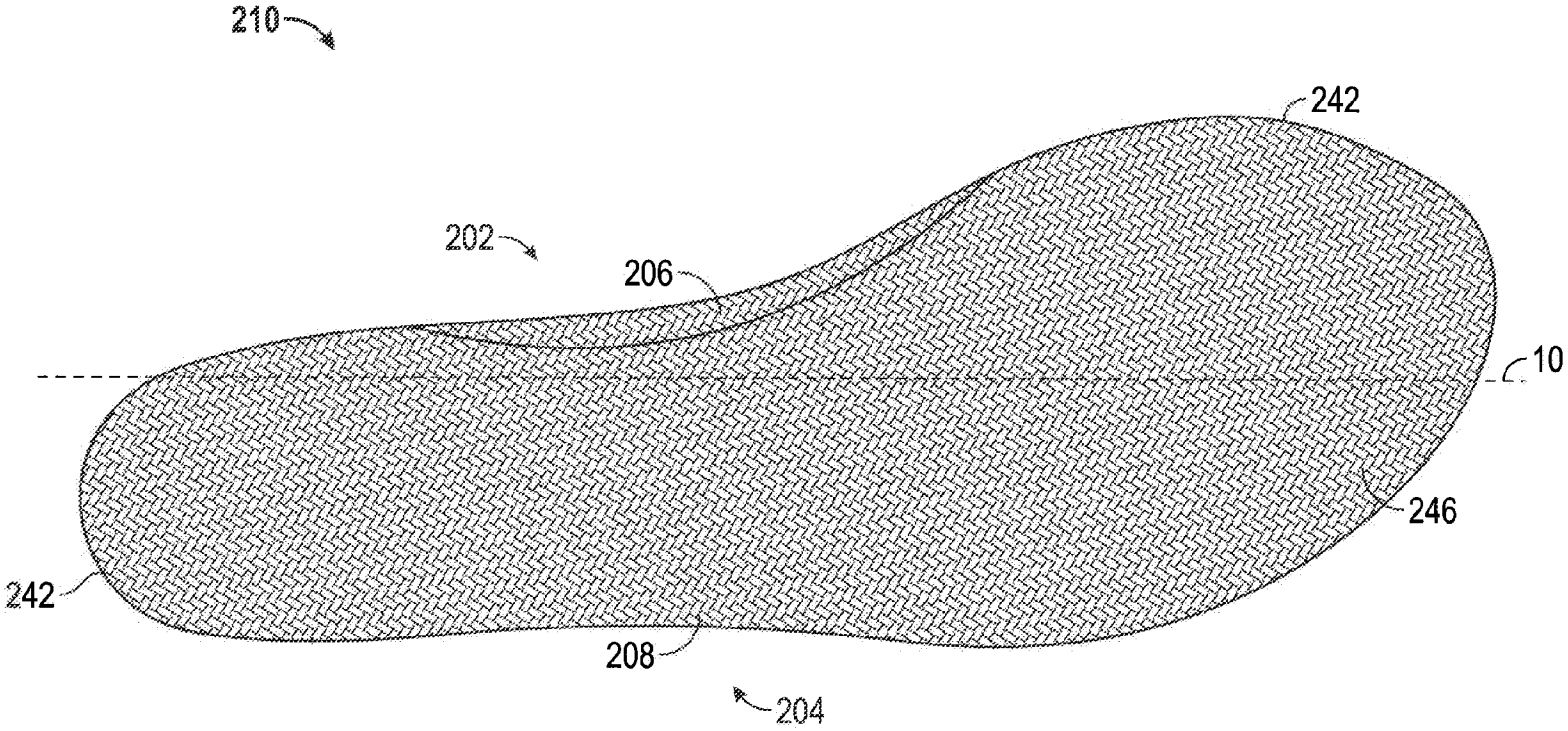
FIG. 14 illustrates a bottom view of a midsole plate, according to an embodiment presented herein.

As described herein, midsole plate 210 can be constructed of multiple layers of material. For example, in some embodiments (see, e.g., FIG. 11), a first (bottom) layer of midsole plate 210 can be formed of TPU (e.g., a TPU film 224, which may or may not be a portion of a resin used to form one or more of the other layers of midsole plate 210), a second layer can be formed of a carbon fiber twill weave (e.g., a carbon fiber twill weave 226, which may be oriented at 35 degrees (positive or negative) from longitudinal axis 10—see, e.g., FIG. 16), a third layer (e.g., stiffening layer 222) can be formed of carbon fiber uni-directional material (e.g., a carbon fiber uni-directional material 228, which may be oriented parallel to longitudinal axis 10), and a fourth (top) layer can be formed of TPU (e.g., a TPU film 230, which may or may not be a portion of a resin used to form one or more of the other layers of midsole plate 210). In some embodiments, all fiber layers are layered and molded together.

Carbon fiber twill weave 226 may be generally flexible and resilient, and may contribute torsional stability and medial-lateral flexibility to midsole plate 210. Carbon fiber twill weave 226 may extend to peripheral edge 242 of midsole plate 210. Carbon fiber uni-directional material 228 may be more stiff in the direction of its fibers than in other directions, and may contribute localized longitudinal stiffness to midsole plate 210 when its fibers are oriented along longitudinal axis 10.

Carbon fiber uni-directional material 228 can be positioned in an area where flexing is not desired, and where greater stability is desired. For example, in some embodiments, carbon fiber uni-directional material 228 can be positioned in midfoot area 214 (see, e.g., stiffening layer 222 in FIGS. 9 and 13), in rearfoot area 216, and/or in forefoot area 212. In some embodiments, carbon fiber uni-directional material 228 can extend to edges of midsole plate 210. In some embodiments, carbon fiber uni-directional material 228 may not extend to edges of midsole plate 210 (see, e.g., stiffening layer 222 in FIGS. 9 and 13). In some embodiments, carbon fiber uni-directional material 228 can have a constant width (see, e.g., stiffening layer 222 in FIGS. 9 and 13). In some embodiments, carbon fiber uni-directional material 228 can have a varying width (e.g., carbon fiber uni-directional material 228 can be wider at one or both ends and narrower between its ends). In some embodiments, carbon fiber uni-directional material 228 can be oriented such that its fibers extend in a longitudinal, heel-toe direction. In some embodiments, carbon fiber uni-directional material 228 can be oriented such that its fibers extend in a transverse, medial-lateral direction. In some embodiments, carbon fiber uni-directional material 228 can be oriented such that its fibers extend in a direction between the longitudinal, heel-toe direction and the transverse, medial-lateral direction.

Figure 15:
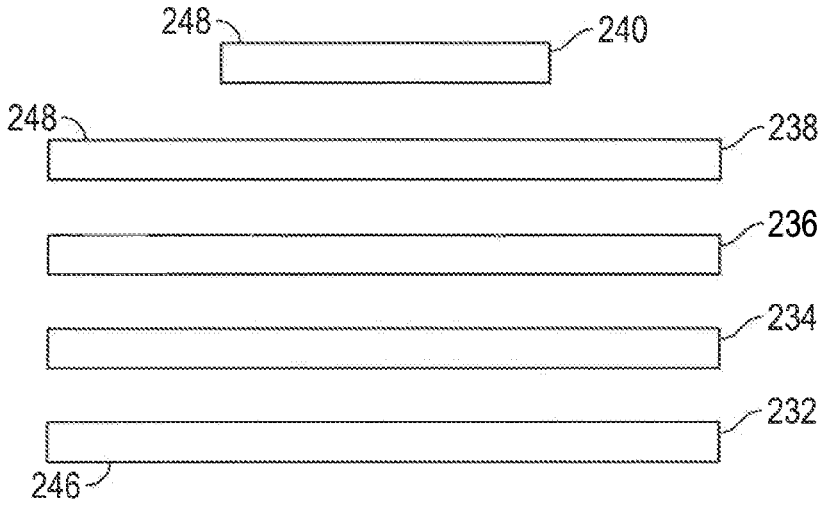
FIG. 15 illustrates an exploded view of a midsole plate, according to an embodiment presented herein.

For further example, in some embodiments (see e.g., FIG. 15), a first (bottom) layer of midsole plate 210 can be formed of an aluminized glass twill weave (e.g., an aluminized glass twill weave 232, which may be oriented as desired—e.g., 35 degrees (positive or negative) from longitudinal axis 10), a second layer can be formed of a glass fiber uni-directional material (e.g., a glass fiber uni-directional material 234, which may be oriented to impact flexibility as desired), a third layer can be formed of a glass fiber uni-directional material (e.g., a glass fiber uni-directional material 236, which may be oriented to impact flexibility as desired), a fourth layer can be formed of a glass fiber uni-directional material (e.g., a glass fiber uni-directional material 238, which may be oriented to impact flexibility as desired), a fifth layer (e.g., stiffening layer 222) can be formed of carbon fiber uni-directional material (e.g., a carbon fiber uni-directional material 240, which may be oriented as desired—e.g., parallel to longitudinal axis 10). In some embodiments, the glass fiber uni-directional materials 234, 236, and 238 (making up the second, third, and fourth layers) are alternatingly oriented at positive 35 degrees, negative 35 degrees, positive 35 degrees with respect to longitudinal axis 10, or negative 35 degrees, positive 35 degrees, negative 35 degrees with respect to longitudinal axis 10. In some embodiments, all fiber layers are layered and molded together.

Aluminized glass twill weave 232 may be generally flexible and resilient, and may contribute torsional stability and medial-lateral flexibility to midsole plate 210. Glass fiber uni-directional materials 234, 236, and 238 may each be more stiff in the direction of its fibers than in other directions, and may together contribute to the overall stiffness and stability of midsole plate 210 due to their contributions of stiffness in both longitudinal and transverse directions. Aluminized glass twill weave 232 and glass fiber uni-directional materials 234, 236, and 238 may extend to peripheral edge 242 of midsole plate 210. Carbon fiber uni-directional material 240 may be more stiff in the direction of its fibers than in other directions, and may contribute localized longitudinal stiffness to midsole plate 210 when its fibers are oriented along longitudinal axis 10.

Carbon fiber uni-directional material 240 can be positioned in an area where flexing is not desired, and where greater stability is desired. For example, in some embodiments, carbon fiber uni-directional material 240 can be positioned in midfoot area 214 (see, e.g., stiffening layer 222 in FIGS. 9 and 13), in rearfoot area 216, and/or in forefoot area 212. In some embodiments, carbon fiber uni-directional material 240 can extend to edges of midsole plate 210. In some embodiments, carbon fiber uni-directional material 240 may not extend to edges of midsole plate 210 (see, e.g., stiffening layer 222 in FIGS. 9 and 13). In some embodiments, carbon fiber uni-directional material 240 can have a constant width (see, e.g., stiffening layer 222 in FIGS. 9 and 13). In some embodiments, carbon fiber uni-directional material 240 can have a varying width (e.g., carbon fiber uni-directional material 240 can be wider at one or both ends and narrower between its ends). In some embodiments, carbon fiber uni-directional material 240 can be oriented such that its fibers extend in a longitudinal, heel-toe direction. In some embodiments, carbon fiber uni-directional material 240 can be oriented such that its fibers extend in a transverse, medial-lateral direction. In some embodiments, carbon fiber uni-directional material 240 can be oriented such that its fibers extend in a direction between the longitudinal, heel-toe direction and the transverse, medial-lateral direction.

The layers of midsole plate 210 described herein may be manufactured using a thermoplastic or thermoset manufacturing process. For example, in a thermoplastic process, the layers may be heated and consolidated under pressure (e.g., at a temperature of approximately 450 degrees Fahrenheit to 550 degrees Fahrenheit, and at a compression molding pressure in excess of 1200 pounds per square inch.)

The flexibility of sole 200 may also be influenced by elements other than midsole plate 210, such as, for example, upper 300 coupled to midsole plate 210 or midsole support 250 coupled to midsole plate 210. In some embodiments, midsole support 250 is coupled to midsole plate 210. Midsole support 250 may be formed of one or more discrete midsole support elements 252 formed of, for example, a wear resistant material, including, but not limited to, synthetic or natural rubber, polyurethane (e.g., TPU), foam (e.g., ethylene vinyl acetate (EVA)-based foam or polyurethane (PU)-based foam, where the foam may be an open-cell foam or a closed-cell foam), or a combination thereof, or any suitable material typically utilized for an outsole to provide additional traction and/or wear resistance. In some embodiments, midsole support 250 may be formed of a high abrasion rubber compound, such as, for example, Shin Ho KA2BF.

Midsole support elements 252 coupled to midsole plate 210 can influence flexibility of midsole plate 210 depending on their configuration and construction. For example, a thicker midsole support element 252 positioned at an area of midsole plate 210 may limit flexibility of that area more than a thinner midsole support element 252 positioned in the same area. In some embodiments, midsole support 250 includes a forward midsole support element 254 that is thinner than a rearward midsole support element 256, thereby limiting rearfoot flexibility more than forefoot flexibility. In this way, the greater flexibility of areas of midsole plate 210 (e.g., midsole plate flexion zone 220) can be overcome, reducing the magnitude of or eliminating altogether their comparatively greater flexibility, depending on the characteristics of midsole support elements 252.

The shape and/or position of midsole support elements 252 coupled to midsole plate 210 can also influence the flexibility of midsole plate 210. For example, midsole support elements 252 having a serpentine shape around a peripheral edge 242 of midsole plate 210 (as shown in, for example, FIGS. 2 and 3) may impart less additional stiffness to midsole plate 210 than a solid (e.g., rectangular) shape. Similarly, midsole support elements 252 having a thinner or smaller serpentine shape (e.g., forward midsole support element 254) may impart less additional stiffness to midsole plate 210 than midsole support elements 252 having a thicker or larger shape (e.g., rearward midsole support element 256).

Midsole support elements 252 can also contribute to the structural integrity of midsole plate 210. Midsole support elements 252 can be positioned to help minimize cracking or other failure of midsole plate 210 by dispersing loads due to flexion. By constraining relative motion of portions of midsole plate 210 (e.g., by virtue of their affixation thereto), midsole support elements 252 can absorb loads imposed thereon by flexion, to minimize the chances of crack formation (i.e., the disjunctive relative motion of adjacent portions of midsole plate 210) and/or propagation. Crack formation and propagation can be promoted by substantial and/or repeated flexion, particularly at edges (e.g., peripheral edge 242).

Figure 2:
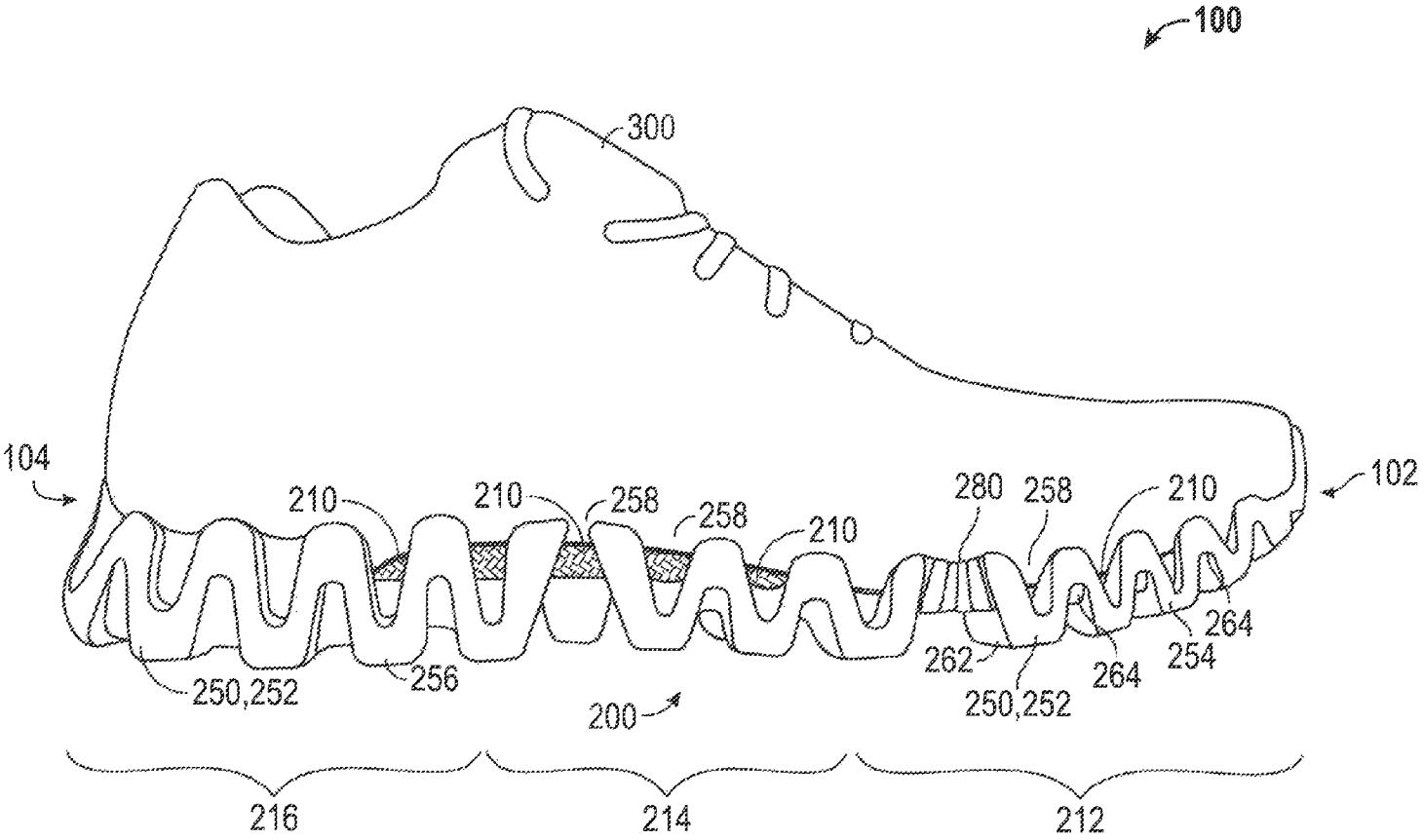
FIG. 2 illustrates a medial side view of an article of footwear, according to an embodiment presented herein.
Figure 3:
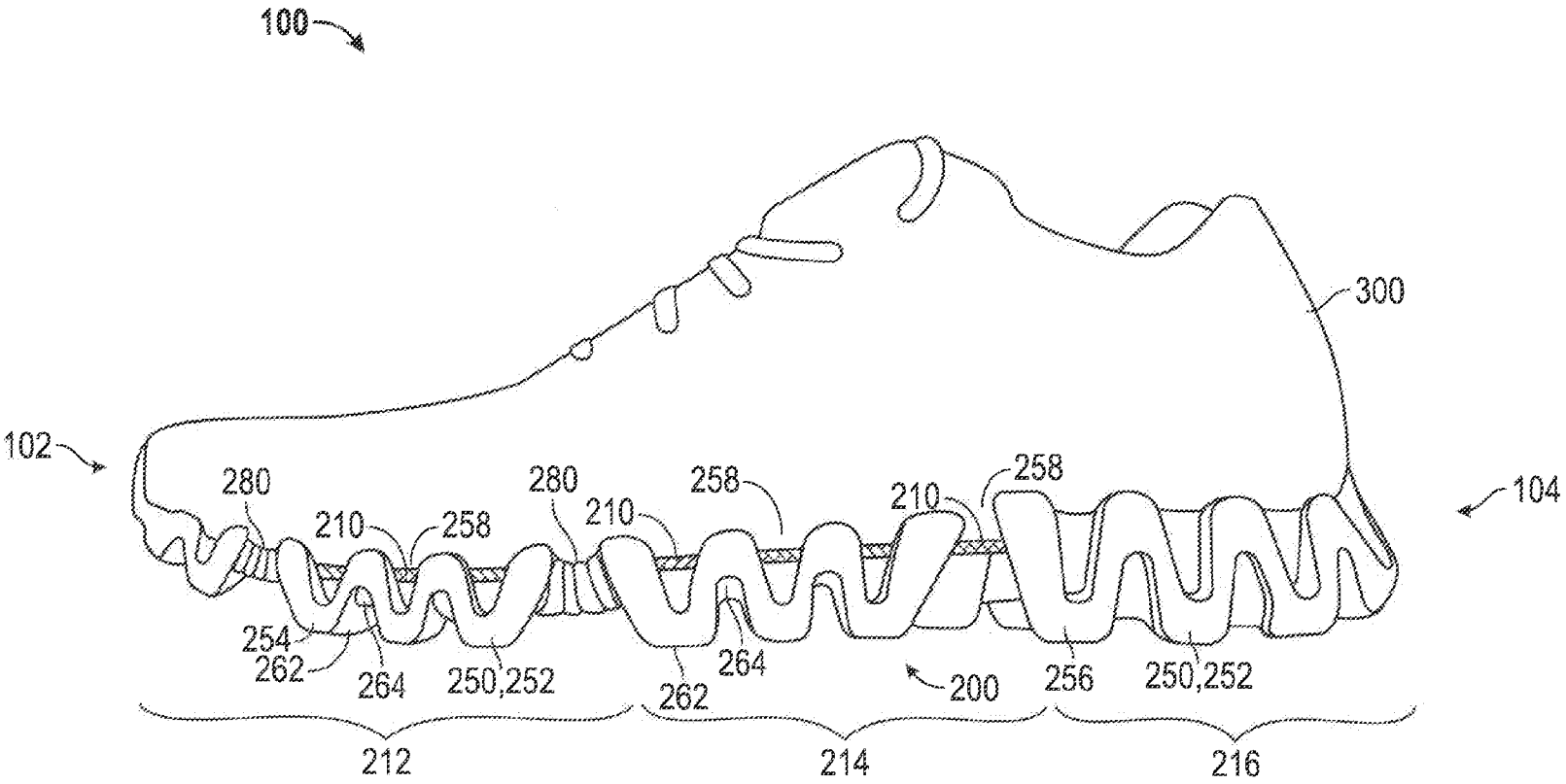
FIG. 3 illustrates a lateral side view of an article of footwear, according to an embodiment presented herein.
Figure 4:
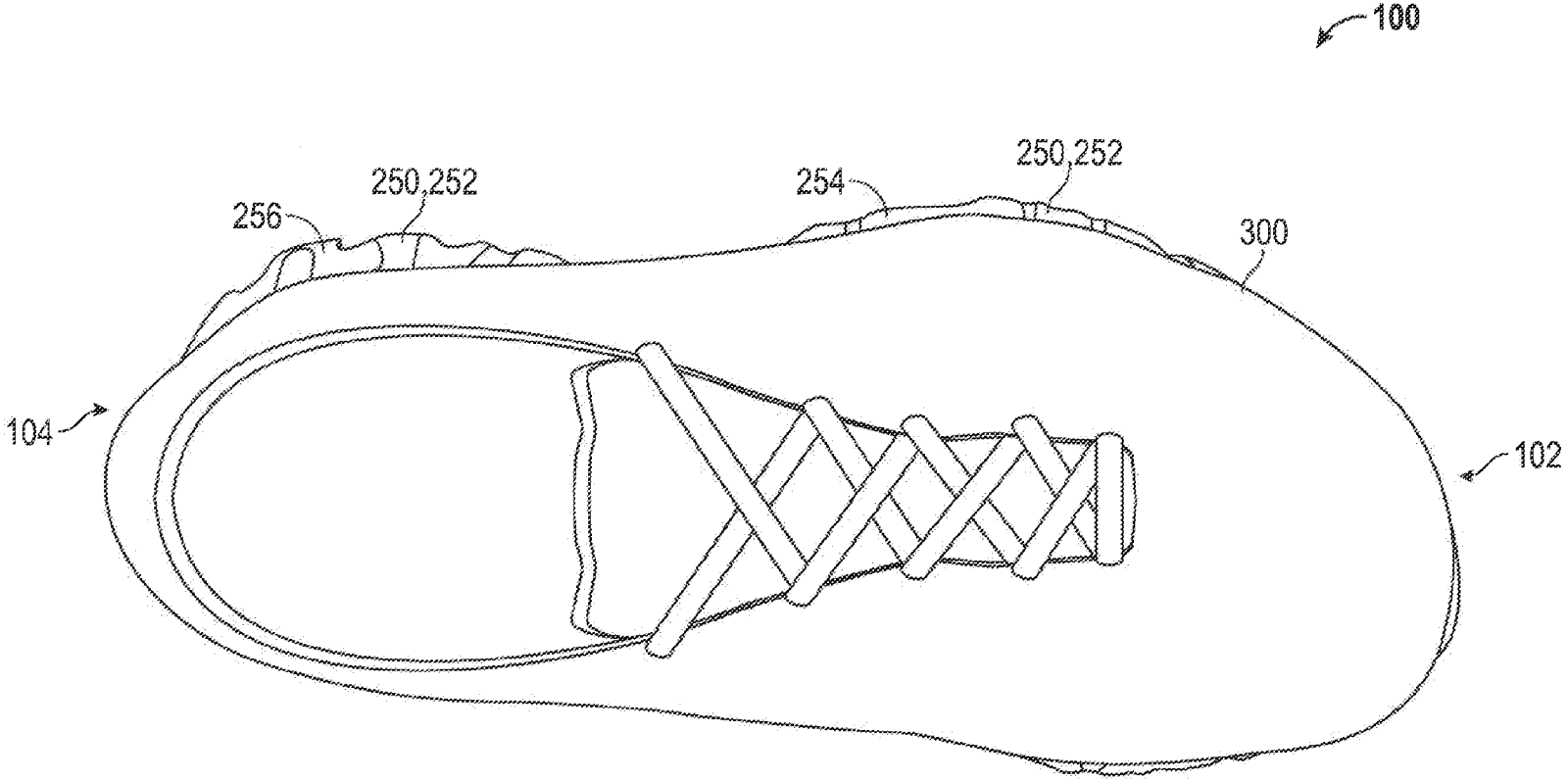
FIG. 4 illustrates a top view of an article of footwear, according to an embodiment presented herein.
Figure 20:
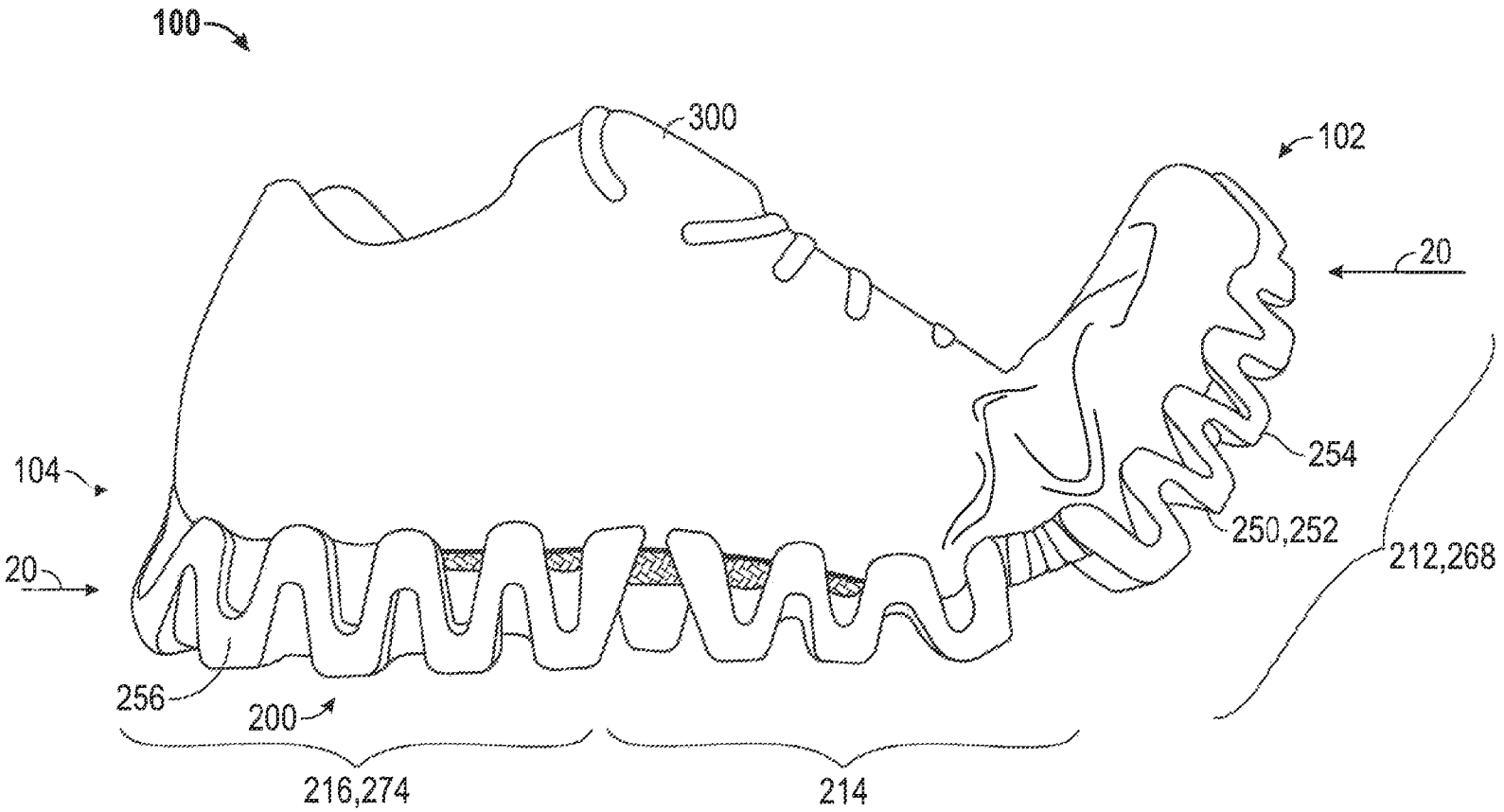
FIG. 20 illustrates a medial side view of an article of footwear applied with a force, according to an embodiment presented herein.

In some embodiments, midsole support elements 252 can be positioned at areas of midsole plate 210 expected to experience substantial flexion (e.g., flexion to a greater degree than other portions of midsole plate 210) and/or repeated flexion (e.g., repeated to a greater extent than other portions of midsole plate 210), such as, for example, forefoot area 212 (see, e.g., FIGS. 2, 3, and 20). In some embodiments, a single midsole support element 252 extends around the entire peripheral edge 242 of midsole plate 210. In some embodiments, a forward midsole support element 254 extends around a forefoot peripheral edge of midsole plate 210, and/or a rearward midsole support element 256 extends around a rearfoot peripheral edge of midsole plate 210 (see, e.g., FIG. 5).

In some embodiments, one or more gaps 258 are formed between adjacent spaced-apart midsole support elements 252 or between adjacent spaced-apart portions of the same continuous midsole support element 252, leaving a portion of the peripheral edge 242 of midsole plate 210 exposed (i.e., uncovered by midsole support elements) through gap(s) 258 (see, e.g., FIGS. 2 and 3). In some embodiments, a continuous midsole support element 252 includes one or more gaps 258 along the peripheral edge 242 of midsole plate 210. In some embodiments, such a gap 258 can be larger in an area not expected to be subject to (or otherwise protected from) substantial or repeated flexion (e.g., midfoot area 214), due to the otherwise lower chance of crack formation and/or propagation. In some embodiments, such a gap 258 can be smaller (if present at all) in areas expected to be subject to substantial or repeated flexion (e.g., forefoot area 212), to protect against the otherwise higher chance of crack formation and/or propagation. In some embodiments, most of peripheral edge 242 is covered by midsole support element(s) 252 in areas subject to substantial and/or repeated flexion (e.g., forefoot area 212).

In some embodiments, midsole support elements 252 can be provided covering portions of a bottom surface 246 of midsole plate 210, and can extend downwardly from midsole plate 210 to connect to outsole elements (or can themselves form an outsole), to engage the ground when used by a wearer. In some embodiments, outsole elements coupled to midsole support elements 252 can be formed of a material having different (e.g., greater) abrasion-resistance and/or traction (e.g., in some embodiments, rubber, polyurethane, and/or resin) than that of midsole support elements 252. In some embodiments, outsole elements can cover substantially all of the bottom surfaces of midsole support elements 252. In some embodiments, outsole elements can cover one or more portions of the bottom surfaces of midsole support elements 252 (e.g., those portions, or a subset thereof, expected to be subject to the greatest abrasion; for example, the ground-engaging surfaces of the rearfoot area and/or the medial side of the forefoot area).

Midsole support elements 252 (and/or outsole elements, if included) can include grooves 260 to define discrete ground-engaging surfaces 262 therebetween at the lower extents of midsole support elements 252. Such grooves 260 can increase traction of article of footwear 100 on the ground, and can influence the flexibility of sole 200. For example, transversely extending grooves 260 (corresponding to a peak—e.g., peak 264—of forward midsole support element 254 in side view) can facilitate longitudinal bending of sole 200.

Grooves 260 can be of varying shape and/or size (e.g., width and depth), and peaks 264 can correspondingly vary in shape and/or size. A larger groove 260 (e.g., having greater width and/or depth) may have greater flexibility than a smaller groove 260 (e.g., having lesser width and/or) depth. For example, medial forefoot groove 276 and lateral forefoot groove 278 may be larger than other grooves 260, and therefore may have greater flexibility. In some embodiments, peaks 264 can define notches 280 at their upper edge, where the material of midsole support 250 defines a concave-like profile in side view. In some embodiments, peaks 264 corresponding to larger grooves may include notches 280, while peaks corresponding to smaller grooves 260 may not. Such notches 280 can allow for greater motion of attached upper 300 than may be possible without such notches 280, thereby reducing the potential for the upper to bunch in the area of notches 280, and increasing the flexibility and comfort of article of footwear 100.

In some embodiments article of footwear 100 has greater flexibility along a transverse path connecting opposing grooves 260 on opposite sides of sole 200 than in other areas of article of footwear 100. In some embodiments, such a transverse path extends between larger grooves 260, such as medial forefoot groove 276 and opposing lateral forefoot groove 278 (see, e.g., FIG. 5). In some embodiments, peaks 264 corresponding to these larger grooves 260 (e.g., medial forefoot groove 276 and lateral forefoot groove 278) include notches 280. In some embodiments the transverse path connecting these opposing grooves may traverse an expanse of exposed area of midsole plate 210, thereby promoting greater flexibility along this transverse path. In some embodiments such a transverse path extends along an area of sole 200 expected to correspond to the metatarsal axis of a typical wearer. Corresponding grooves establishing such a transverse path may be larger than other grooves, to allow for comparably greater flexibility. Such grooves may include transversely-extending ridges 282 (see, e.g., FIG. 5) to further facilitate flexion.

In some embodiments, midsole support 250 includes midsole support elements 252 that can be sized and positioned to provide desired support and ground contact surface, while minimizing contribution to the overall weight of article of footwear 100. For example, midsole support elements 252 may be positioned about the peripheral edge of sole 200 and/or one or more portions thereof, while leaving a central portion of midsole plate 210 exposed, thereby supporting the weight of a wearer about the peripheral edge. Some embodiments of midsole support 250 additionally include midsole support elements 252 in the form of inward projections 266 that can extend from peripheral edge portions of sole 200, to provide support to the central portion of midsole plate 210. In some embodiments, inward projections 266 extend from both the medial and lateral side of article of footwear 100. In some embodiments, inward projections 266 extend from both the medial and lateral side of article of footwear 100 and are staggered so as to define a serpentine exposed area of midsole plate 210 therebetween. In some embodiments, the transverse path aligned with the metatarsal axis may extend between a peak and adjacent trough of the serpentine exposed area, as shown, for example, in FIG. 5. In some embodiments inward projections 266 extend between each other from opposing sides of sole 200 to form a gear-like mesh, with a serpentine exposed area of midsole plate 210 defined around meshing inward projections 266, as shown, for example, in FIG. 5. In some embodiments, inward projections 266 can be replaced with separate midsole support elements 252 positioned in the otherwise exposed central portion of midsole plate 210. In some embodiments, inward projections 266 may be positioned to provide desired cushioning and stability effects while midsole plate 210 may also impart desired flexibility, resilience, and support effects. In this manner, some embodiments of the present invention may simultaneously provide desired effects to provide a consistent ride for the wearer.

As noted, in some embodiments inward projections 266 can extend from edges of sole 200 toward an interior of sole 200, and can provide support and stability to article of footwear 100, at least by providing ground-engaging surfaces 262 in a middle area of forefoot area 212. In some embodiments, one or more inward projections extending from one side of sole 200 extend more than half the distance to the other side of sole 200 (in the direction of extension).

Figure 5:
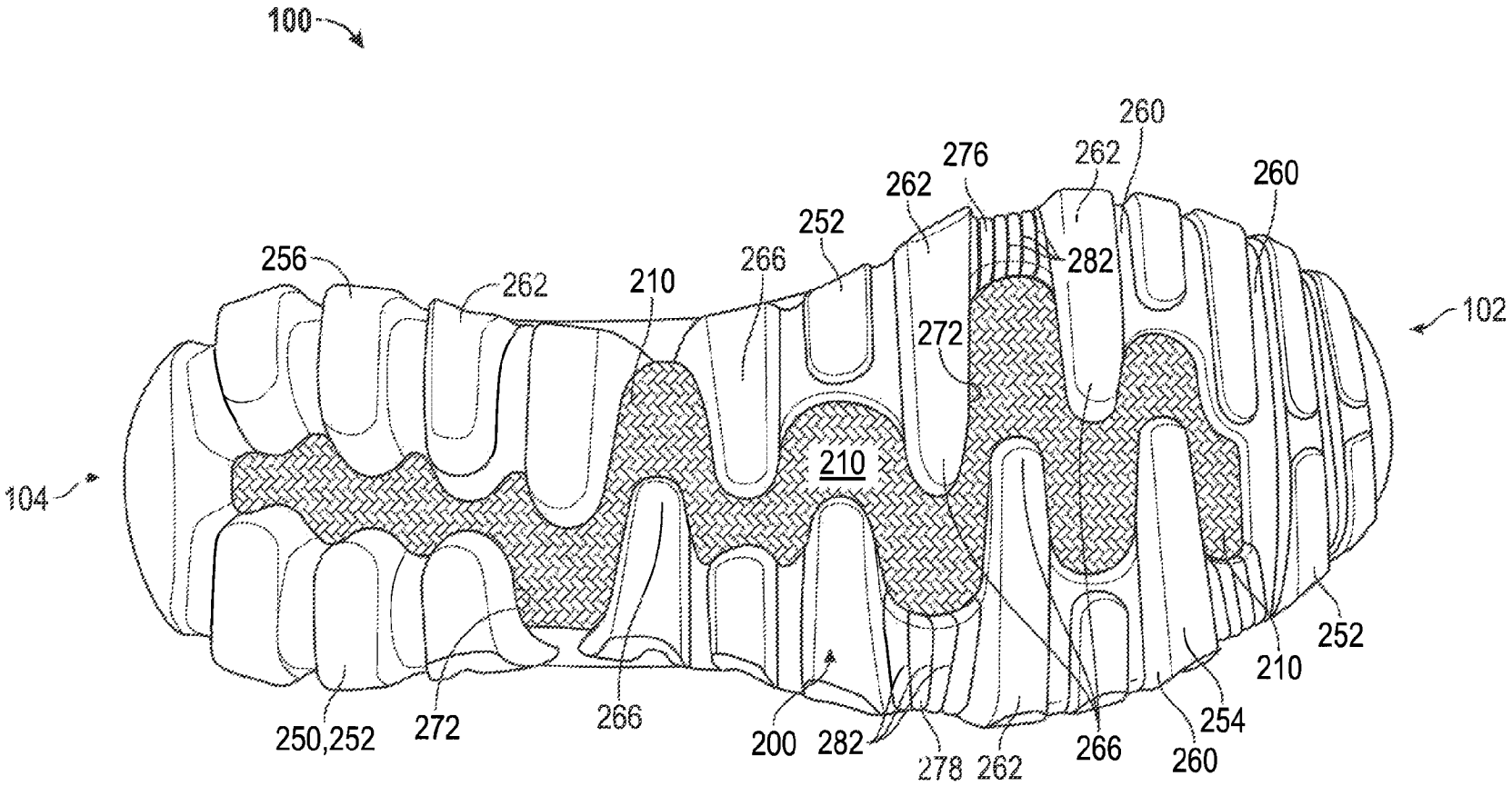
FIG. 5 illustrates a bottom view of an article of footwear, according to an embodiment presented herein.
Figure 6:
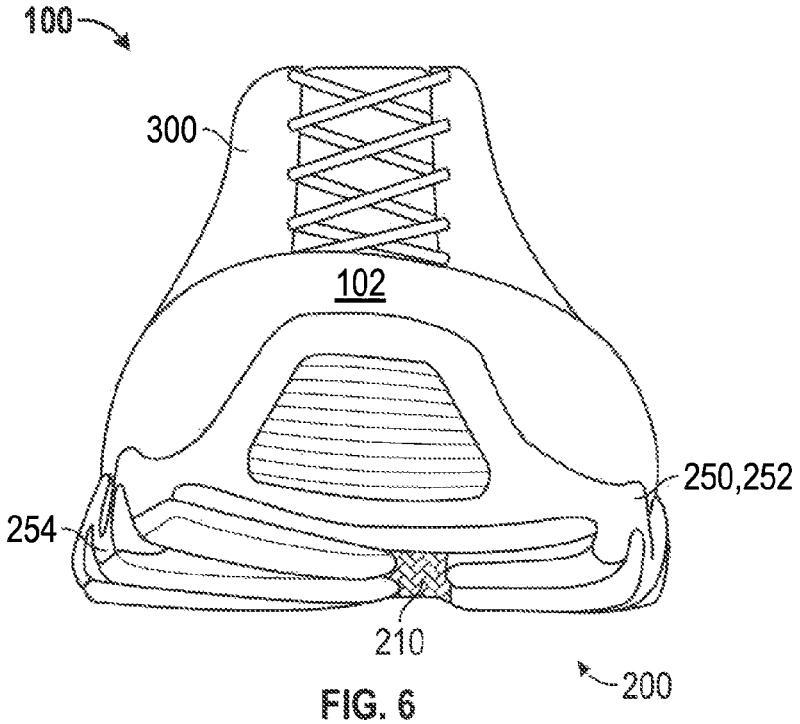
FIG. 6 illustrates a front view of an article of footwear, according to an embodiment presented herein.
Figure 7:
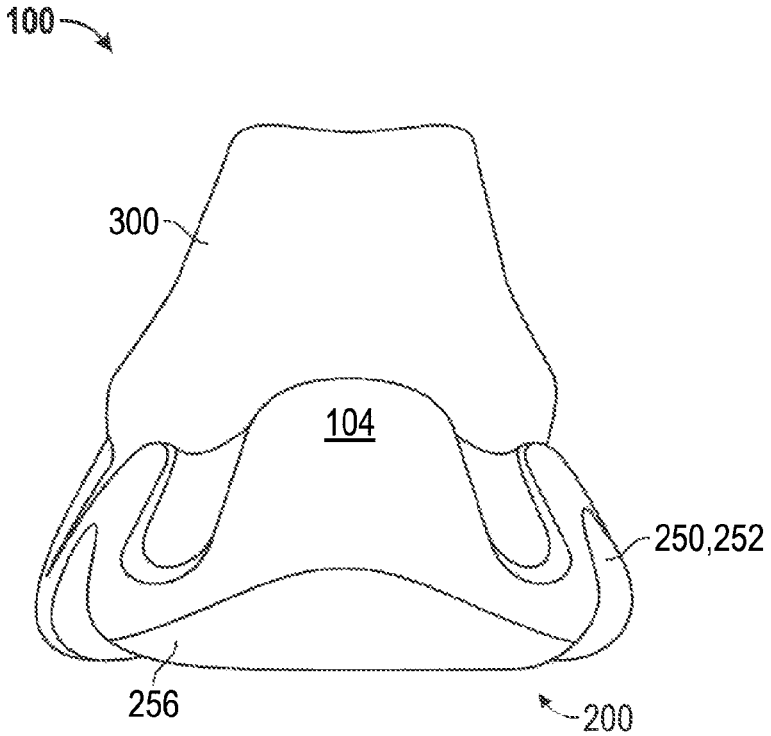
FIG. 7 illustrates a rear view of an article of footwear, according to an embodiment presented herein.
Figure 8:
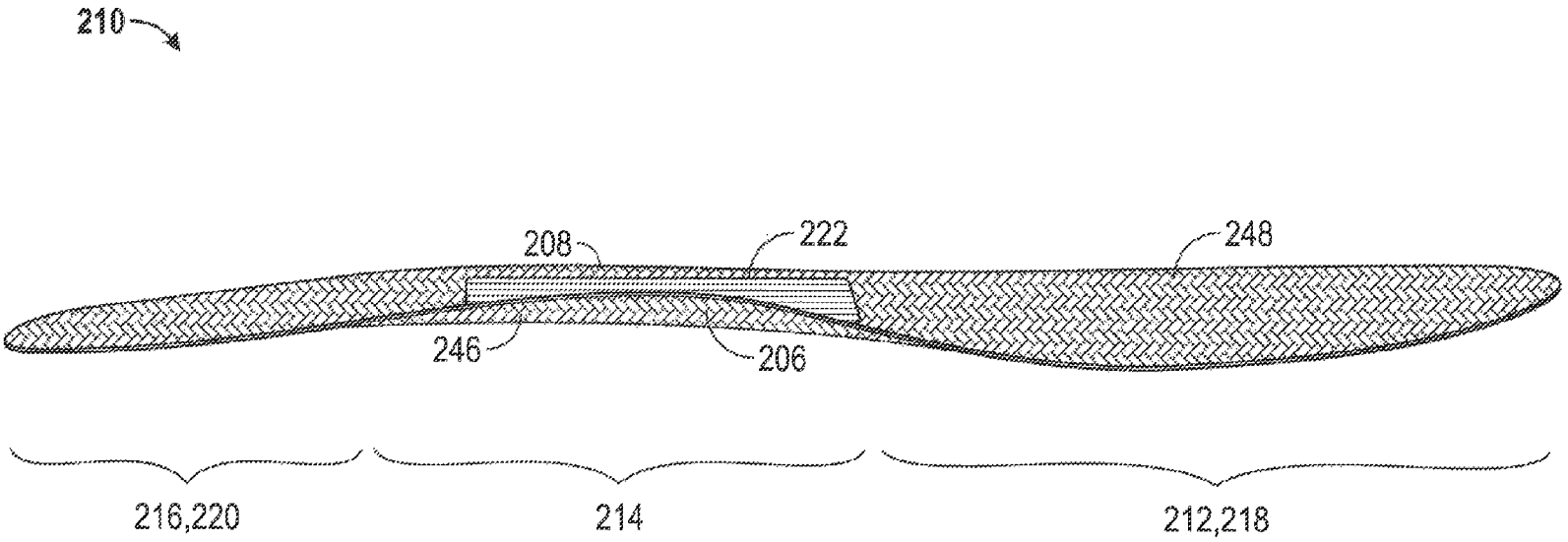
FIG. 8 illustrates a medial side view of a midsole plate, according to an embodiment presented herein.
Figure 9:
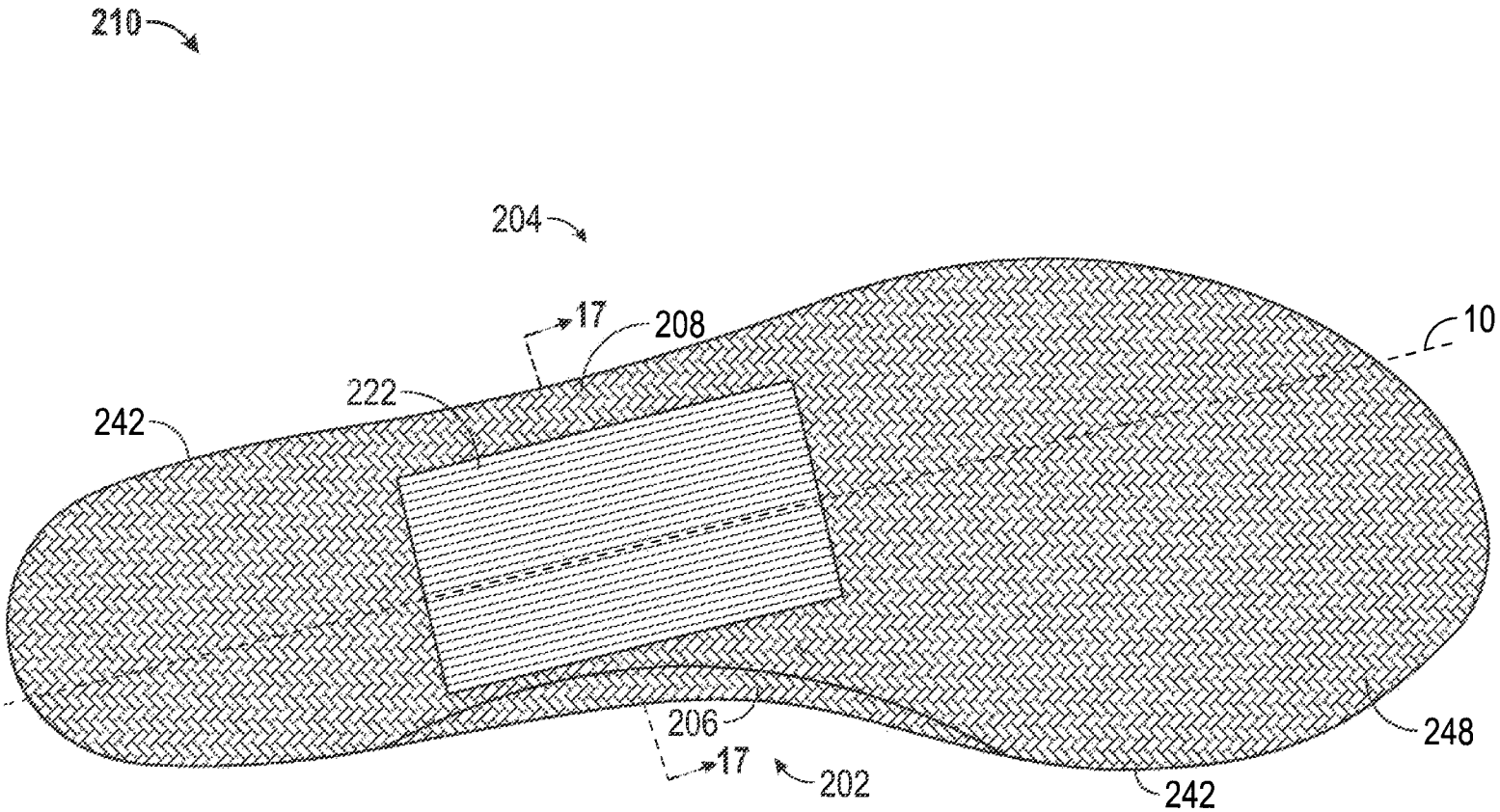
FIG. 9 illustrates a top view of a midsole plate, according to an embodiment presented herein.
Figure 10:
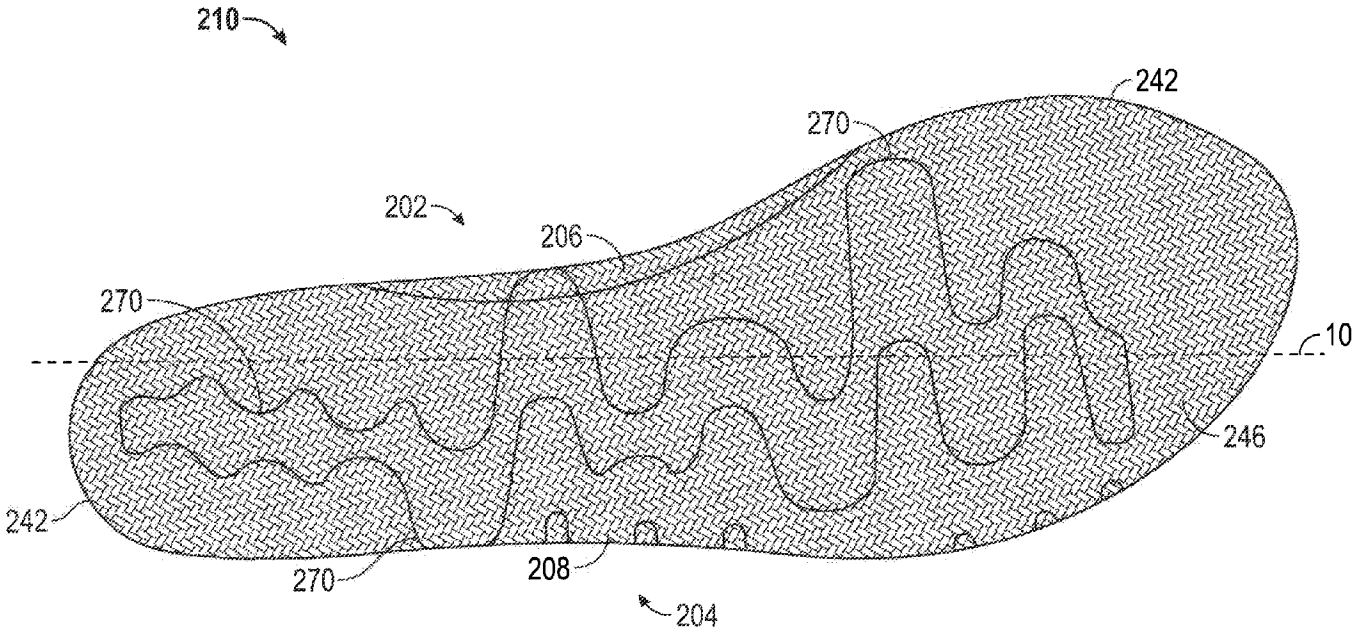
FIG. 10 illustrates a bottom view of a midsole plate, according to an embodiment presented herein.

In some embodiments, one or more inward projections extending from one side of sole 200 extend about half the distance to the other side of sole 200 (in the direction of extension). In some embodiments, one or more inward projections extending from one side of sole 200 extend less than half the distance to the other side of sole 200 (in the direction of extension). Inward projections 266 can extend in any desired configuration. For example, inward projections 266 can extend from both a medial side 202 and a lateral side 204 of sole 200, and can be staggered so that adjacent inward projections 266 extending from opposite sides of sole 200 extend next to each other, and do not meet, as shown in FIG. 5, for example.

In other words, inward projections 266 projecting inward from medial side 202 of the periphery of bottom surface 246 can extend between inward projections 266 projecting inward from lateral side 204 of the periphery of bottom surface 246. Such a configuration can result in an interior border 272 of midsole support 250 defining a serpentine shape, as shown, for example, in FIG. 5. Further, such a configuration can leave portions of midsole plate 210 exposed between opposing portions of midsole support 250 (e.g., in a serpentine shape, as shown in FIG. 5) and can provide stability to article of footwear 100 without adding unnecessary weight or bulk to article of footwear 100 in the exposed areas. Further, the configuration (e.g., position, size, thickness) of inward projections 266 can impact the flexibility of article of footwear 100, as described herein.

Midsole support 250 (including midsole support elements 252) may be formed using suitable techniques, including, but not limited to, injection molding, overmolding, blow molding, compression molding, and rotational molding. In some embodiments, midsole support 250 may be formed of midsole support elements 252 directly injected to midsole plate 210. In some embodiments, midsole support 250 may be formed separately and attached to midsole plate 210. In some embodiments midsole support 250 may be attached to midsole plate 210 by adhesive bonding, welding, or other suitable chemical or mechanical technique(s). As noted herein, in some embodiments, midsole plate 210 includes a coating (e.g., an outer layer of TPU film 224, which may or may not be a portion of a resin used to form one or more of the other layers of midsole plate 210), which may be formed to define one or both of a bottom surface 246 and top surface 248 of midsole plate 210. Such a coating can facilitate adhesion of midsole support 250 to midsole plate 210. For example, EVA foam midsole support elements 252 may adhere to midsole plate 210 better if adhered to the coating instead of directly to a fiber-reinforced polymer layer of midsole plate 210. In some embodiments, such a coating can be transparent (e.g., to show layers underneath, such as, for example, a fiber-reinforced polymer layer), colored (e.g., to create a desired visual aesthetic effect, textured (e.g., to create a desired visual aesthetic and/or tactile effect), and/or can include a desired graphic (e.g., a printed graphic). In some embodiments, to promote adhesion midsole support elements 252 can be adhered to midsole plate 210 along their edges (e.g., along interior border 272). In some embodiments, to limit the introduction of unnecessary weight due to excess adhesive, midsole support elements 252 can be adhered to midsole plate 210 only along their edges.

In some embodiments, to facilitate proper application of adhesive to midsole plate 210 during production, midsole plate 210 can include adhesive guides 270, which may be raised areas of coating (e.g., an outer layer of TPU film 224, which may or may not be a portion of a resin used to form one or more of the other layers of midsole plate 210), arranged in a pattern on midsole plate 210, where the pattern corresponds to the intended placement of midsole support elements 252 (and/or edges thereof). In such embodiments, the coating may include a base having a lesser thickness, and a raised pattern having a greater thickness, where the raised pattern forms adhesive guides 270. In some embodiments the raised pattern may protrude from the base by about 0.2 millimeters. Such a thickness maximizes the visual effect of adhesive guides 270 while maintaining sufficient resin permeation throughout midsole plate 210 in embodiments where the coating (and adhesive guides 270) are formed from such resin. A manufacturer can apply adhesive along adhesive guides 270 to promote proper and consistent adhesive placement and consequent affixation of midsole support elements 252. In some embodiments, adhesive guides 270 are formed by a raised pattern extending along a border between a covered area (e.g., an area covered by or intended to be covered by midsole support elements 252) and an uncovered area (e.g., an area not covered by or not intended to be covered by midsole support elements 252). The raised pattern may be on the covered area side of the border, and may protrude from the base relative to both the uncovered area and the balance of the covered area. In some embodiments, the raised pattern is formed over all or a portion of the covered area. In some embodiments, the raised pattern is formed over all or a portion of the uncovered area. In embodiments the raised pattern may define a ridge at the border between the covered area and uncovered area (e.g., in embodiments where the raised pattern is formed over all of either the covered area or uncovered area).

Techniques described herein can be implemented individually or in combination to achieve desired flexibility, resilience, and support for article of footwear 100 (e.g., a desired flexibility profile along longitudinal axis 10). For example, article of footwear 100 may have a flexibility profile along its longitudinal axis that is comparatively stiff (i.e., having lesser flexibility than other areas of article of footwear 100) in midfoot area 214 in order to support the arch (midfoot area 214) of a wearer, and that is comparatively flexible (i.e., having greater flexibility than other areas of article of footwear 100) in forefoot area 212 in order to allow article of footwear 100 to flex in concert with articulation of a wearer's metatarsophalangeal joints during the wearer's gait cycle (e.g., while walking). In some embodiments, rearfoot area 216 may have flexibility between the comparatively lower flexibility of midfoot area 214 and the comparatively higher flexibility of forefoot area 212, in order to impart cushioning and support, for example, during heel strike of a wearer's gait cycle.

Figure 21:
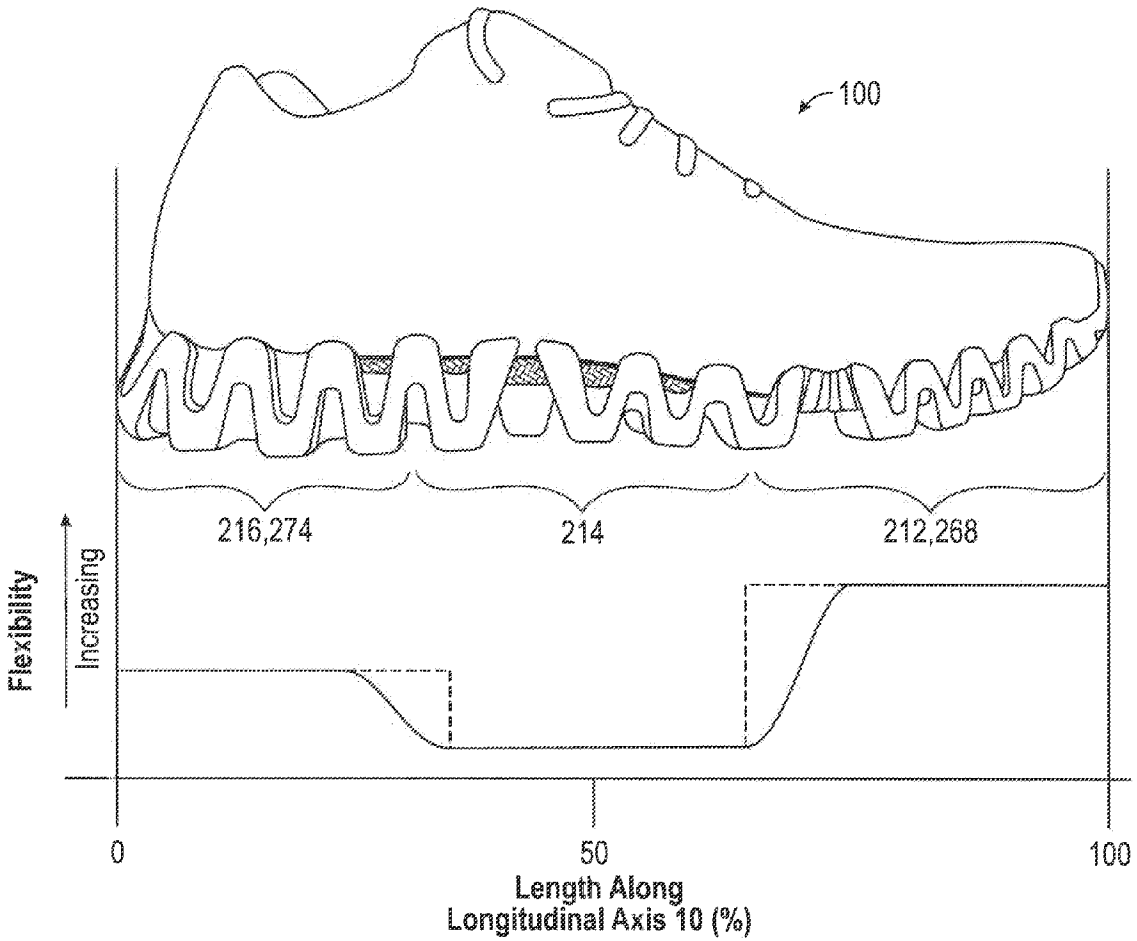
FIG. 21 is a graph representing flexibility of an article of footwear, according to an embodiment presented herein.

Such a configuration may result in article of footwear 100 having article of footwear flexion zones 268 and 274 in forefoot area 212 and rearfoot area 216, respectively, as shown, for example, in FIGS. 20 and 21 (corresponding to midsole plate flexion zones 218 and 220, respectively). To effect such a configuration, in some embodiments peripheral edge 242 can be provided with rearward midsole support element 256 at rearfoot area 216, and with forward midsole support element 254 at forefoot area 212. Rearward midsole support element 256 can be configured to limit flexion of sole 200 to a greater extent than forward midsole support element 254 (e.g., by being configured thicker, and/or covering more area, than forward midsole support element 254), resulting in article of footwear flexion zone 268 positioned in forefoot area 212 of article of footwear 100 and an article of footwear flexion zone 274 positioned in rearfoot area 216 of article of footwear 100, where flexion zone 268 has greater flexibility than flexion zone 274.

FIG. 20, for example, illustrates article of footwear 100 having article of footwear flexion zone 268 applied with inward force 20, which is applied equally to both forefoot area 212 and rearfoot area 216. Article of footwear 100 substantially maintains its form along its area of lesser flexibility (rearfoot area 216 and midfoot area 214), and bends in areas of greater flexibility (forefoot area 212). FIG. 21, for example, provides a graphical representation of the flexibility of article of footwear 100, having comparatively lower flexibility in midfoot area 214, comparatively higher flexibility in forefoot area 212, and flexibility between the comparatively lower and comparatively higher areas in rearfoot area 216. As shown in FIG. 21, flexibility can increase or decrease between areas of higher and lower flexibility. Such increase/decrease can be gradual (shown by the solid line) or abrupt, as in a step function (shown by the broken line). In either case, a flexion zone can be formed beginning at the transition. The characteristics of the increase/decrease can be affected by, for example, the flexibility and position of layers of midsole plate 210, the position and degree of curvature of midsole plate 210 (e.g., medial curve 206, lateral curve 208), and/or the position, size, and composition of elements external to midsole plate 210 (e.g., midsole support elements 252).

The foregoing description of the specific embodiments of the article of footwear described with reference to the figures will so fully reveal the general nature of the invention that others can, by applying knowledge within the skill of the art, readily modify and/or adapt for various applications such specific embodiments, without undue experimentation, without departing from the general concept of the present invention.

In some embodiments, midsole plate 210 may extend over less than substantially all of the forefoot, midfoot, and rearfoot of article of footwear 100. For example, midsole plate 210 may be disposed in only the forefoot, only the midfoot, or only the rearfoot of article of footwear 100. Also for example, midsole plate 210 may be disposed in only the forefoot and midfoot or only the midfoot and rearfoot of article of footwear 100. In some embodiments, midsole plate 210 may not be continuous, and may be formed of two or more separate pieces. For example, midsole plate 210 may include a first piece disposed in the forefoot and a second, unconnected, piece formed in the rearfoot of article of footwear 100. In some embodiments, midsole plate 210 may define holes therethrough. For example, midsole plate 210 may define a hole (e.g., a hole having a circular or scalloped shape) at the rearfoot, forefoot, and/or midfoot thereof. In some embodiments, midsole plate 210 may be formed to define projections. For example, midsole plate 210 may define one or more (e.g., three) projections extending generally longitudinally and having free ends in the forefoot thereof, which projections may or may not be connected at a rearfoot, midfoot, or rear forefoot of midsole plate 210 (e.g., by merging into a continuous portion of midsole plate 210).

While various embodiments of the present invention have been described above, they have been presented by way of example only, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present invention. The elements of the embodiments presented above are not necessarily mutually exclusive, but may be interchanged to meet various needs as would be appreciated by one of skill in the art.

It is to be understood that the phraseology or terminology used herein is for the purpose of description and not of limitation. The breadth and scope of the present invention should not be limited by any of the above-described exemplary embodiments, but should be defined only in accordance with the following claims and their equivalents.

What is claimed is:

1. A sole for an article of footwear, the sole comprising:

a fiber-reinforced polymer plate extending from a heel area of the article of footwear to a toe area of the article of footwear; and a midsole support coupled to the fiber-reinforced polymer plate and having a plurality of peaks disposed above the fiber-reinforced polymer plate and a plurality of troughs disposed below the fiber-reinforced polymer plate, wherein there is a gap between the fiber-reinforced polymer plate and at least one of the plurality of troughs, wherein flexibility of the fiber-reinforced polymer plate varies as a function of location along a longitudinal axis of the fiber-reinforced polymer plate, wherein the fiber-reinforced polymer plate extends in the heel area from a medial edge of the article of footwear to a lateral edge of the article of footwear, wherein the fiber-reinforced polymer plate comprises a stiffening layer disposed at a midfoot area of the fiber-reinforced polymer plate, wherein a width of the stiffening layer is less than a width of the fiber-reinforced polymer plate at the midfoot area, and wherein medial and lateral edge portions of the fiber-reinforced polymer plate in the heel area are not turned up.

2. The sole of claim 1, wherein flexibility of a forefoot area of the fiber-reinforced polymer plate is greater than flexibility of the midfoot area of the fiber-reinforced polymer plate.

3. The sole of claim 2, wherein the forefoot area of the fiber-reinforced polymer plate is resilient.

4. The sole of claim 3, wherein resilience of the forefoot area promotes a spring effect upon transitioning from a bent state to an un-bent state.

5. The sole of claim 1, wherein flexibility of a forefoot area of the article of footwear is greater than flexibility of a midfoot area of the article of footwear.

6. The sole of claim 1, wherein the stiffening layer comprises unidirectional fiber tape having fibers oriented parallel to the longitudinal axis.

7. The sole of claim 1, wherein a forefoot area of fiber-reinforced polymer plate is configured to transition from a neutral state to a bent state and from the bent state to the neutral state, in response to a wearer's gait cycle.

8. A sole for an article of footwear, the sole comprising:

a fiber-reinforced polymer plate extending from a heel area of the article of footwear to a toe area of the article of footwear; and a midsole support coupled to the fiber-reinforced polymer plate and having a plurality of peaks disposed above the fiber-reinforced polymer plate and a plurality of troughs disposed below the fiber-reinforced polymer plate, wherein the fiber-reinforced polymer plate is formed of first fibers woven with second fibers, wherein the midsole support extends around a peripheral edge of the fiber-reinforced polymer plate, wherein the plurality of peaks and the plurality of troughs of the midsole support define a serpentine shape along the peripheral edge of the fiber-reinforced polymer plate that extends above and below the fiber-reinforced polymer plate, wherein there is a gap between the fiber-reinforced polymer plate and at least one of the plurality of troughs, and wherein a continuous portion of the midsole support covers two portions of the peripheral edge spaced apart by an uncovered portion of the peripheral edge.

9. The sole of claim 8, wherein the midsole support is coupled to a bottom surface of the fiber-reinforced polymer plate, wherein a portion of the bottom surface of the fiber-reinforced polymer plate is uncovered by the midsole support, and wherein the uncovered portion of the bottom surface of the fiber-reinforced polymer plate defines a serpentine area disposed in a forefoot area of the fiber-reinforced polymer plate.

10. The sole of claim 8, wherein the midsole support comprises a forward midsole support element continuously extending around the peripheral edge of the fiber-reinforced polymer plate at a forefoot area of the fiber-reinforced polymer plate, wherein the midsole support comprises a rearward midsole support element continuously extending around the peripheral edge of the fiber-reinforced polymer plate at a rearfoot area of the fiber-reinforced polymer plate, and wherein the forward midsole support element and the rearward midsole support element are spaced apart on a medial and a lateral side of the fiber-reinforced polymer plate at a midfoot area of the fiber-reinforced polymer plate.

11. The sole of claim 8, comprising a thermoplastic layer disposed on a bottom surface of the fiber-reinforced polymer plate, wherein the thermoplastic layer comprises a base thickness and a raised pattern having a thickness greater than the base thickness.

12. The sole of claim 11, wherein the raised pattern corresponds to an interior border of the midsole support where the midsole support meets the fiber-reinforced polymer plate.

13. The sole of claim 12, wherein the midsole support is adhered to the fiber-reinforced polymer plate by adhesive disposed along the elongate raised pattern.

14. A sole for an article of footwear, the sole comprising:

a fiber-reinforced polymer plate extending from a heel area of the article of footwear to a toe area of the article of footwear, wherein the fiber-reinforced polymer plate comprises:

a plurality of first fibers, the first fibers extending parallel to each other; and a plurality of second fibers, the second fibers extending parallel to each other; and a midsole support coupled to the fiber-reinforced polymer plate and having a plurality of peaks disposed above the fiber-reinforced polymer plate and a plurality of troughs disposed below the fiber-reinforced polymer plate, wherein the plurality of first fibers is woven with the plurality of second fibers, wherein the plurality of first fibers is oriented at an oblique angle with respect to a longitudinal axis of the article of footwear, wherein the plurality of second fibers is oriented perpendicularly to the plurality of first fibers, wherein the midsole support extends around a peripheral edge of the fiber-reinforced polymer plate, wherein there is a gap between the fiber-reinforced polymer plate and at least one of the plurality of troughs, and wherein the fiber-reinforced polymer plate comprises a stiffening layer of unidirectional fiber tape formed of a plurality of fibers positioned only in parallel with respect to each other and disposed at a midfoot area of the article of footwear.

15. The sole of claim 14, wherein the fiber-reinforced polymer plate comprises carbon fiber.

16. The sole of claim 14, wherein the fiber-reinforced polymer plate comprises glass fiber.

17. A sole for an article of footwear, the sole comprising:

a fiber-reinforced polymer plate formed of first fibers woven with second fibers;

a midsole support extending around a periphery of a bottom surface of the fiber-reinforced polymer plate, in a forefoot area of the fiber-reinforced polymer plate; and a thermoplastic layer disposed on the bottom surface of the fiber-reinforced polymer plate, wherein a continuous interior border of the midsole support is a continuous serpentine shape and defines a serpentine-shaped exposed portion of the fiber-reinforced polymer plate, wherein the thermoplastic layer comprises a base thickness and a raised pattern having a thickness greater than the base thickness, and wherein the raised pattern defines a ridge at the continuous interior border of the midsole support.

18. The sole of claim 17, wherein the serpentine-shaped exposed portion of the fiber-reinforced polymer plate is between opposing portions of the midsole support in the forefoot area.

19. The sole of claim 17, wherein the midsole support comprises first inward projections that project inward from a medial side of the periphery of the bottom surface of the fiber-reinforced polymer plate, wherein the midsole support comprises second inward projections that project inward from a lateral side of the periphery of the bottom surface of the fiber-reinforced polymer plate.

20. The sole of claim 19, wherein the first inward projections extend between the second inward projections.

21. The sole of claim 19, wherein the first inward projections and the second inward projections are each part of a unitary portion of the midsole support.

22. The sole of claim 17, wherein the continuous interior border of the midsole support is a continuous serpentine shape on a medial side of the serpentine-shaped exposed portion of the fiber-reinforced polymer plate and a continuous serpentine shape on a lateral side of the serpentine-shaped exposed portion of the fiber-reinforced polymer plate and wherein the continuous interior border is continuous between the medial and the lateral side of the serpentine-shaped exposed portion of the fiber-reinforced polymer plate.

* * * * *